US005729120A

United States Patent [19]

Stich et al.

[11] Patent Number: 5,729,120

[45] Date of Patent: Mar. 17, 1998

[54] DYNAMIC VOLTAGE REGULATION STABILIZATION FOR AC POWER SUPPLY SYSTEMS

[75] Inventors: Frederick A. Stich, Wisconsin Rapids; Donald K Zahrte, Sr., Necedah; Gregory C. Kohls, Nekoosa; Robert R. Davidson, Mauston, all of Wis.

[73] Assignee: General Signal Corporation, Stamford, Conn.

[21] Appl. No.: 781,896

[22] Filed: Dec. 30, 1996

[51] Int. Cl.[6] ..... G05F 1/613

[52] U.S. Cl. ..... 323/237; 323/235; 323/239; 323/220; 323/223; 307/64; 363/89

[58] Field of Search ..... 323/220, 223, 323/288, 283, 284, 237, 235, 239; 307/64, 59; 363/63, 39, 89

[56] References Cited

U.S. PATENT DOCUMENTS

| | | | |
|---|---|---|---|
| 4,015,171 | 3/1977 | Miller | 361/18 |
| 4,038,559 | 7/1977 | Chun et al. | 307/64 |
| 4,692,854 | 9/1987 | Baxter, Jr. et al. | 363/75 |
| 4,843,533 | 6/1989 | Roof et al. | 363/55 |
| 4,998,098 | 3/1991 | Schweitzer, III | 340/662 |
| 5,182,518 | 1/1993 | Stich et al. | 324/511 |
| 5,426,579 | 6/1995 | Paul et al. | 363/126 |

*Primary Examiner*—Peter S. Wong
*Assistant Examiner*—Shawn Riley
*Attorney, Agent, or Firm*—Foley & Lardner

[57] ABSTRACT

Instabilities in the output voltage provided from an AC power supply system such as an uninterruptible power supply connected to a power factor correcting load are suppressed by a dynamic voltage regulation stabilizer system which is connected across the output lines from the power supply system to the load. The DVR stabilizer system includes a rectifier connected to the power supply system output lines. A capacitor is connected across the output nodes of the rectifier. Switching devices form a bridge that connects the capacitor to the output lines. Selected switching devices in the bridge are turned on for a selected duration encompassing the time of the peak of each half-cycle of the AC voltage waveform provided by the power supply system. During normal operation, where the peak AC voltage from the power supply system is substantially constant, the capacitor charges up through the rectifier to a voltage level near the peak value of the AC voltage waveform. When the peak AC voltage level rises above the normal peak level, the capacitor clamps the voltage across the output lines at a value near the steady state peak value. When the peak voltage level drops below the normal peak value, the capacitor discharges through the switching device bridge during the peak of the half-cycle to fill in for the voltage drop. The DVR stabilizer system thus reduces the effect of interactions between the power supply system and the PFC load, to thereby dampen oscillations and stabilize the AC voltage waveform.

32 Claims, 10 Drawing Sheets to FIG. 8B
to FIG. 8B
a
b
c
+15V
250
240
236
238
244
246
248
100K
234
10K
232
230
20K
256
254
252
47uF
1uF
262
260
100K
1M
258
264
266
268
.1uF
270
20K
272
47uF
226
10K
228
224
100K
222
100K
220
25
26
322
100K
321
100K
320
325
10K
324
86
13V
323
+CAP
-CAP
404
3K
402
3K
406
DISCHARGE CIRCUIT
400
412
47K
416
414
20K
430
410
220uF
428
20K
426
10K
47
408
424
220uF
418
47K
420
5.1V
422
R

DYNAMIC VOLTAGE REGULATION STABILIZATION FOR AC POWER SUPPLY SYSTEMS

FIELD OF THE INVENTION

This invention pertains generally to the field of electrical and electronic power supplies, and particularly to the stabilization of uninterruptible power supplies, transformers, and the like which are connected to loads having power factor correction circuits.

BACKGROUND OF THE INVENTION

In recent years, the internal power supplies of computers and other electrical and electronic equipment have become smaller, of lower weight, and less costly. In many cases, such power supplies have been designed so that they do not require a transformer. Electronic equipment incorporating a power supply without a transformer typically have an input circuit consisting of an input bridge rectifier which produces direct current from the alternating current (AC) input power. Such bridge circuits typically employ a capacitive input filter. Unfortunately, the capacitive input filter and the rectifier circuit present a poor power factor which is reflected back to the AC power system that is providing power to the load.

To compensate for the poor power factor of transformerless internal power supplies, computers and other products having such power supplies have been introduced which include power factor correction (PFC) circuits. PFC circuits change the capacitive power factor of the transformerless power supply of such electronic equipment to approximately unity power factor. While PFC power circuits have reduced the power factor problems caused by electronic equipment having transformerless power supplies, they have introduced a new set of problems, particularly where the PFC load is not connected directly to the AC power mains, but is supplied with power through an intermediate AC power supply system.

Intermediate power supply systems can include linear transformers used for isolation or voltage change, ferroresonant transformers, uninterruptible and standby power supplies, DC-to-AC inverters, line conditioners, as well as AC generators and the like. Uninterruptible power supplies (UPS), standby power supplies (SPS), and line conditioners are widely used to protect the power supplied to critical loads, such as computers, emergency lighting, fluorescent lamp ballasts, other electronic ballasts, and the like, which commonly use transformerless power supplies. It has been found that when load equipment which incorporates a PFC circuit is connected to receive power from these AC power supply systems, instability, manifested as an oscillation in the output voltage provided to the load, may occur. Particularly affected are UPSs and SPSs which employ voltage regulation with feedback, either electronic or magnetic, which is derived either directly or indirectly from the output terminals. Also affected are other AC power supply systems, including those which employ voltage regulation or which use a ferroresonant transformer or a linear transformer with high leakage reactance in the power supply path.

Interaction between the peak currents demanded by the PFC load and the voltage regulation circuitry of a UPS or SPS, or with the reactive characteristics of a transformer, can create an unstable situation in which feedback can produce undesirable and wide fluctuations of the amplitude of the voltage and current supplied to the PFC load. A PFC circuit demands current in the form of pulses which supply the energy lost by the capacitive filter to the load. The PFC circuit also creates a simulated current which is sinusoidal in shape and is in phase with the applied voltage. These current demands can generate a voltage drop across the leakage reactance of the power supply system transformer. When the demand for current ceases, the voltage regulator action of the power supply system, or the collapsing magnetic field within the transformer, induces an increasing transient voltage at the output of the AC power supply system. This increasing transient voltage causes an increase of current into the filter capacitor of the PFC load, triggering the action of the PFC circuit, causing it to demand more "correcting" current. This increased current demand causes a voltage drop across the output of the regulated power supply, or the transformer leakage reactance, and the cycle repeats itself. Thus, interaction between the PFC load and the power supply system providing power to the load can result in an undesirable cyclic oscillation of the AC power supply system output voltage and current peaks (e.g., an amplitude modulation of the 60 Hz sinusoidal power) which, once initiated, can be difficult to stop.

Such oscillations can also occur where power is supplied through a power supply system including a ferroresonant transformer, such as a UPS including a ferroresonant transformer in the power supply path, to a PFC load, motor, or any large surge load. The ferroresonant transformer is an inherently soft source. A soft source is one which is slow to respond to, or unable to support, increased current demands. These characteristics of a soft source can cause problems when PFC loads, motors, or any large surge loads are connected to a power supply system including a ferroresonant transformer. Motors and surge loads may demand current from the power supply which causes the output voltage of the transformer to drop. Under extreme cases, the current demand of the motor or surge load may cause the output voltage of the transformer to collapse completely (no output voltage), leaving the UPS or other system incorporating the ferroresonant transformer in an unrecoverable condition.

PFC loads present a different problem to the power supply system incorporating a ferroresonant transformer. A surge load on a PFC supply will cause the supply to draw a large amount of current. This large current demand results in a voltage drop on the output of the ferroresonant transformer. This usually results in the PFC load trying to draw even more current, thereby causing the output from the ferroresonant transformer to drop even further. Eventually, the PFC load will have sufficiently charged its capacitive filter, and the current demand from the PFC load will drop suddenly. At this point, sufficient energy has been built up in the ferroresonant transformer to support the higher current demands of the PFC load. However, since the PFC load no longer requires this higher level of current, the energy stored in the ferroresonant transformer is realized as an output voltage rise. The PFC load responds to the voltage rise by demanding more current, causing the output voltage from the transformer to drop, and the cycle to repeat itself. In some instances, the oscillations resulting from the interactions between a PFC load and a power supply incorporating a ferroresonant transformer can become severe, causing the power supply to shut down. If the power supply system incorporating the ferroresonant transformer is a UPS, the forced shutdown of the power supply system can cause a disruption of power to, and failure of, the critical load that is supported by the UPS.

Various solutions to these instability problems have been sought. One approach is to substitute larger, higher power transformers, as well as differently designed transformers, where a transformer contributes to the instability problem. Larger transformers, which have lower leakage reactances, can minimize the instability problems, but are more expensive, heavier, and occupy more space than a transformer which would be properly sized to service the load if the instability problems were not present.

A method and apparatus for stabilizing the output of AC power supply systems connected to power factor correcting loads is described in U.S. Pat. No. 5,426,579, to Steven J. Paul, et al. As described in this patent, instabilities in the output voltage provided from an AC power supply system to a PFC load may be suppressed by a stabilizer which is connected across the output lines from the power supply system to the load. The described stabilizer includes a diode bridge rectifier having AC input nodes connected to the power supply system output lines, and DC output nodes at which a rectified DC voltage appears. A capacitor and resistor are connected in parallel across the output nodes of the rectifier. During normal operation, where the peak AC voltage from the power supply system is substantially constant, the capacitor charges up, via the rectifier, to a DC voltage level near the steady state zero-to-peak value of the AC voltage waveform. The charge on the capacitor slowly dissipates through the parallel resistor at a rate that does not substantially dissipate the charge on the capacitor between peaks of the AC voltage waveform. When the peak value of the AC voltage waveform rises above the steady state peak level, the voltage across the output lines of the power supply system is clamped by the capacitor and rectifier bridge at a value near the steady state peak value. This clamping operation helps to damp out oscillations in the output voltage waveform, by reducing the effect of positive feedback caused, for example, by interaction between the PFC load and the leakage inductance of the output winding of a transformer in the power supply system. Although this method provides for damping of oscillations by clamping the peak output voltage of the power supply system in the presence of voltage overshoots, it does nothing to prevent the peak voltage undershoots that commonly occur when PFC and surge loads are connected to power supply systems including ferroresonant transformers, and the like. Moreover, in this stabilizing method, energy is constantly being dissipated through the resistor that is connected in parallel with the voltage clamping capacitor. Thus, this stabilizing method is not very efficient.

SUMMARY OF THE INVENTION

In accordance with the present invention, dynamic voltage regulation (DVR) is provided for stabilizing the output of AC power supply systems, such as uninterruptible power supplies (UPS), standby power supplies (SPS), line conditioners, transformers, or transformer based power supplies. DVR stabilization in accordance with the present invention suppresses the tendency of the output of such AC power supply systems to oscillate when connected to power factor correcting (PFC) loads. Oscillation suppression is achieved in accordance with the present invention by preventing feedback interactions between the load and the power supply system. This is accomplished by eliminating both overshoots and undershoots in the peak voltage provided from the AC power supply system to the load. A DVR stabilizer system in accordance with the present invention consumes a very small amount of power, and is adapted to be connected to existing power supply systems and loads.

DVR stabilization in accordance with the present invention is particularly applicable to UPSs, and other power supply systems, incorporating soft source ferroresonant transformers. A DVR stabilizer system in accordance with the present invention reacts quickly to transient conditions to stiffen the output of such soft source power supply systems. The voltage overshoot and undershoot problems common to soft source power supply systems connected to PFC or surge loads, will, therefore, be eliminated. This will allow power supply systems employing ferroresonant transformers to support previously unsupportable loads. DVR stabilization in accordance with the present invention may be used to stiffen any soft source in response to transient conditions. Thus, dynamic voltage regulation in accordance with present invention may be employed generally for line stiffening and/or surge suppression.

A DVR stabilizer system in accordance with the present invention is connected in parallel across the output lines from an AC power supply system to a load. The DVR stabilizer includes a rectifier, such as diodes connected in a bridge configuration, which is connected at its AC input nodes across the power supply system output lines, which are also connected to the, e.g., PFC load. A large bulk capacitor is connected across the DC output nodes of the rectifier bridge. During the normal steady state supply of AC output power across the output lines of the power supply system, the bulk capacitor becomes charged, via the rectifier, to essentially the peak voltage level of the steady state AC output voltage waveform. The size of the capacitor is selected such that the charge on the capacitor is not substantially dissipated between peaks of the AC voltage waveform. Thus, only a small amount of current flows into the DVR stabilizer system during normal operation, at times near the peaks of the AC waveform. If the PFC load begins to cause oscillations in the output voltage of the power supply system, so that the peak output voltage increases beyond the steady state peak output voltage level, the DVR stabilizer system clamps the output voltage at substantially the steady state peak value by diverting the additional current provided by the power supply system through the rectifier and the bulk capacitor. Consequently, a positive feedback interaction between the power supply system and the PFC load is avoided.

Drops in the peak output voltage of the power supply system, i.e., half-cycles of the AC voltage waveform on the output lines of the power supply system during which the peak voltage level does not reach the steady state peak voltage level, are filled in through the use of switching devices which connect the bulk capacitor to the output lines for a selected duration encompassing the time of each peak of the AC output waveform. A bridge of power switching devices, e.g., IGBTs, is preferably used to connect the bulk capacitor to the power supply system output lines. Selected ones of the bridge switching devices are turned on for a selected duration encompassing the time of the peak of each half-cycle of the output voltage waveform to apply the charge on the capacitor in the proper polarity to the power supply system output lines. If the power supply system's output voltage level is lower than the voltage level stored on the bulk capacitor, i.e., lower than the steady state peak AC voltage level, then current is supplied from the bulk capacitor through the switching device bridge to the power supply system output lines and the load to raise the peak voltage level on the output lines to approximately the steady state voltage level. Thus, in accordance with the present invention, voltage on the power supply system output lines is stored in the bulk capacitor by means of the rectifier, and this stored energy is used to fill in any voltage drops, via the bridge power switching devices. The present invention thereby regulates the output voltage waveform of a power supply system dynamically, effectively, and efficiently, to eliminate the voltage excursions which are caused by interaction between the power supply system and a load, thereby eliminating the mechanism which initiates voltage and current oscillations on the power supply system output lines. If oscillations have begun, DVR stabilization in accordance with the present invention will provide adequate damping to stop the oscillatory activity. For motors and surge loads connected to soft source power supply systems, e.g., power supply systems including ferroresonant transformers, the ability of the present invention to fill in voltage drops will prevent the collapse of the power supply system output voltage under surge conditions.

In accordance with the present invention, selected switching devices in a bridge are turned on for a selected duration encompassing the time of the peak of each half-cycle of the AC waveform on the output lines of the power supply system, to thereby connect the bulk capacitor to the output lines. The selected duration of each half-cycle during which the selected switching devices are turned on is preferably centered around the time of occurrence of the peak of the AC voltage waveform. A different half of the bridge is activated on alternating half-cycles such that the voltage on the capacitor is applied in alternating polarities to the output lines. If, and only if, the peak AC output voltage on the output lines drops below the voltage on the bulk capacitor, which is charged to approximately the normal steady state peak voltage level, the bulk capacitor will discharge onto the output lines through the bridge switching devices, to thereby fill in the voltage drop by raising the peak output voltage level to the steady state level.

Control of the switching devices in the bridge is preferably provided by a bridge switching device controller. The controller preferably includes an AC output waveform peak detection system which provides a peak detection signal which determines when and for how long the selected bridge switching devices are to be turned on. The controller also preferably includes a system for distinguishing between the positive and negative half-cycles of the AC output voltage waveform. The positive/negative half-cycle detection system provides positive and negative half-cycle detection signals which determine which of the bridge switching devices need to be turned on during a particular half-cycle. The controller preferably includes a current limit system, to prevent the turning on or to shut off the bridge switching devices when the current provided from the bulk capacitor through the bridge switching devices to the output lines exceeds a current limit threshold level beyond which the switching devices could be damaged. If the capacitor current exceeds a current limit threshold level, the mechanism for turning on the bridge switching devices is disable. The controller also preferably includes a low voltage lockout system, to prevent the bridge switching devices from being turned on if the potential between the peak voltage level on the power supply system output lines and the stored voltage level on the bulk capacitor is too high. If the voltage level on the output lines is below a low voltage threshold level, the mechanism for turning on the bridge switching devices is disabled. This prevents damage to the bridge switching devices from the switching devices being accidentally turned on during startup (until the power supply system is operational) or during a shorted output condition. The bridge controller may be implemented using conventional analog and/or digital circuit components, and may be independently powered by a power supply system deriving power from the stored voltage on the bulk capacitor.

Further objects, features, and advantages of the invention will be apparent from the following detailed description when taken in conjunction with the accompanying drawings.

DETAILED DESCRIPTION OF THE INVENTION

Figure 1:
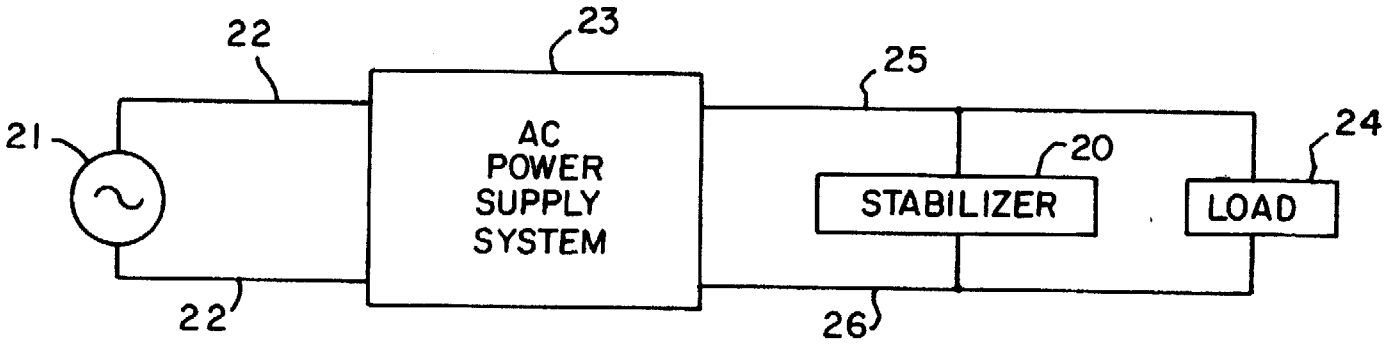
FIG. 1 is a block diagram illustrating the use of a dynamic voltage regulation stabilizer system in accordance with the present invention in conjunction with an AC power supply system and a PFC load.

For purposes of exemplifying the application of the present invention, a dynamic voltage regulation (DVR) stabilizer system 20 in accordance with the present invention is shown in FIG. 1 connected in an electrical distribution system in which power from a main power source 21 is provided on lines 22 to an AC power supply system 23. The AC power supply system 23 supplies power to a load 24 on its output lines 25 and 26. The DVR stabilizer system 20 is connected across the output lines 25 and 26 in parallel with the load 24. Typically, the main source 21 is a utility power grid which characteristically has very low output impedance. If the load 24 were connected directly to the output lines 22 of the main source 21, the actions of the load 24, even if a power factor correcting (PFC) load, would have little effect upon the voltage on the lines 22. However, it is becoming increasingly common for electrical power to be distributed within a building through a local AC power supply system (generally identified at 23 in FIG. 1 for purposes of illustration) which, at least in some circumstances, may have a significant output impedance or other characteristics which cause it to interact with a PFC load 24. Such AC power supply systems can include linear transformers used for voltage step-up or step-down or for isolation, ferroresonant transformers, uninterruptible power supplies (UPS), standby power supplies (SPS), motor-generator sets, line inductors, line conditioners, and voltage regulated AC power supplies. The AC power supply system 23 can also include systems in which the power source 21 is not a utility power grid, but is a local power source, e.g., alternators driven by an internal combustion engine, wind power generators, DC-to-AC inverters supplied from a DC power source such as a battery, and so forth. UPS and SPS typically provide power from a battery to the load when power on the utility mains fails. Thus, the output impedance of a UPS or SPS will generally be higher when it is operating on battery power than when utility power is present, and many UPS and SPS attempt to regulate the output voltage provided to the load when operating on battery power.

The output characteristics of these various types of AC power supply systems can lead to instability when such systems are connected to PFC loads. PFC circuits have been incorporated in power supplies of consuming equipment, such as computers, fluorescent lamps, emergency lighting systems, and other electronic ballasts, and in equipment which itself is intended to be part of the electrical distribution system, e.g., power factor corrected UPS, SPS, and stand alone power supplies. Some types of power supply systems or loads which do not incorporate PFC circuits, such as ferroresonant transformers, have also been observed to cause instability under some circumstances.

The DVR stabilizer system 20 of the present invention serves to eliminate or minimize instabilities in the output power from the power supply system 23 which are otherwise manifested as oscillations in the peak-to-peak output voltage. The DVR stabilizer system 20 does so by dynamically clipping rapid voltage overshoots and filling in rapid voltage undershoots from the power supply system 23, while adapting to long-term changes in the steady state output voltage level.

Figure 2:
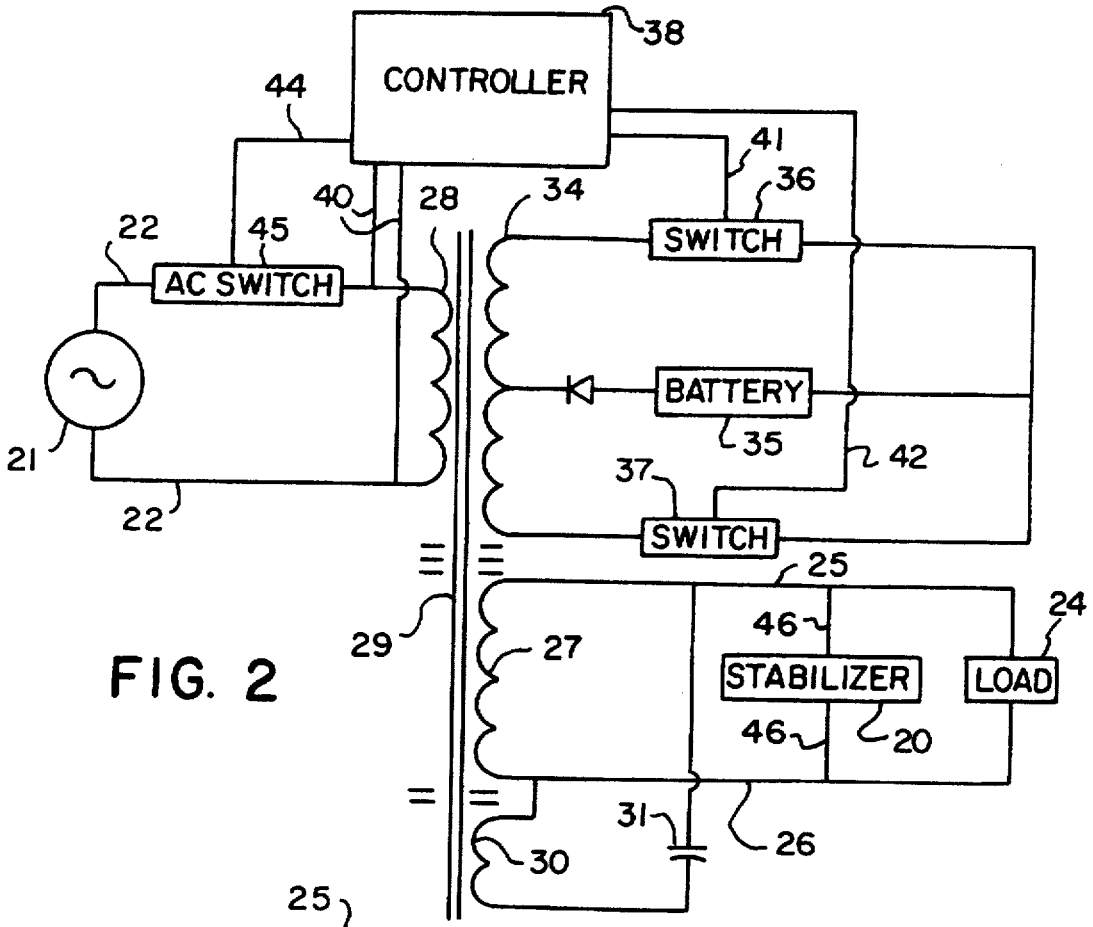
FIG. 2 is a schematic circuit diagram of an exemplary uninterruptible power supply (UPS) system having a ferroresonant transformer to which a dynamic voltage regulation stabilizer system in accordance with the present invention is connected.

A specific exemplary application of the DVR stabilizer system 20 of the present invention is shown in FIG. 2 in conjunction with an uninterruptible power supply (UPS) which receives AC power from a utility power source 21 at input lines 22 and delivers power to a load 24. The exemplary UPS includes a ferroresonant transformer having a primary input winding 28, a core 29, a secondary winding 27 which supplies power on output lines 25 and 26 to the load 24, an additional ferroresonant transformer output winding 30 in series with the winding 27, and a capacitor 31 connected across the windings 27 and 30. To provide power to the load 24 during failure of power from the primary power source 21, an auxiliary primary winding 34 is connected to receive power from a battery 35 through an inverter comprised of switches 36 and 37, the switching of which is controlled by a controller 38. The controller 38 is connected by sensing lines 40 to the power from the AC power source 21 on the input lines 22 to allow failure of the AC power source to be detected. Upon failure of the main AC power, the controller 38 provides control signals on lines 41 and 42 to the switching devices 36 and 37 to switch them in a desired manner to provide AC power on the auxiliary primary 34 from the battery 35 which is transferred across the ferroresonant transformer to the load 24. The control of inverters in UPS systems is well known, and any suitable controller may be used. The controller 38 also provides a control signal on a line 44 to an AC switch 45 to isolate the AC power source 21 from the UPS until normal supply of power is resumed and the supply of power from the battery 35 is discontinued.

The foregoing ferroresonant UPS is described for exemplification only, inasmuch as the present invention may be utilized with any AC power supply system which may require stabilization, including other UPS systems which have a transformer in the primary power path (including linear transformers as well as ferroresonant transformers), voltage regulated UPS systems which do not have a transformer, line conditioners, and other power distribution systems using a transformer with high leakage reactance. The present invention may also be utilized generally for stabilization of the output of soft sources such as ferroresonant transformers, as a line stiffener, and for surge suppression. An example of a UPS with which the present invention may be utilized is shown and described in U.S. Pat. No. 5,182,518, the disclosure of which is incorporated herein by reference.

A DVR stabilizer system 20 in accordance with the present invention is connected across the output lines 25 and 26 from the transformer secondary 27, and is in parallel with the load 24. The DVR stabilizer system 20 clips peak voltage overshoots and fills in peak voltage undershoots on the output lines 25 and 26 to inhibit the feedback which may occur between the output of the winding 27 of the transformer and a PFC load 24, which would otherwise cause oscillations.

Figure 3:
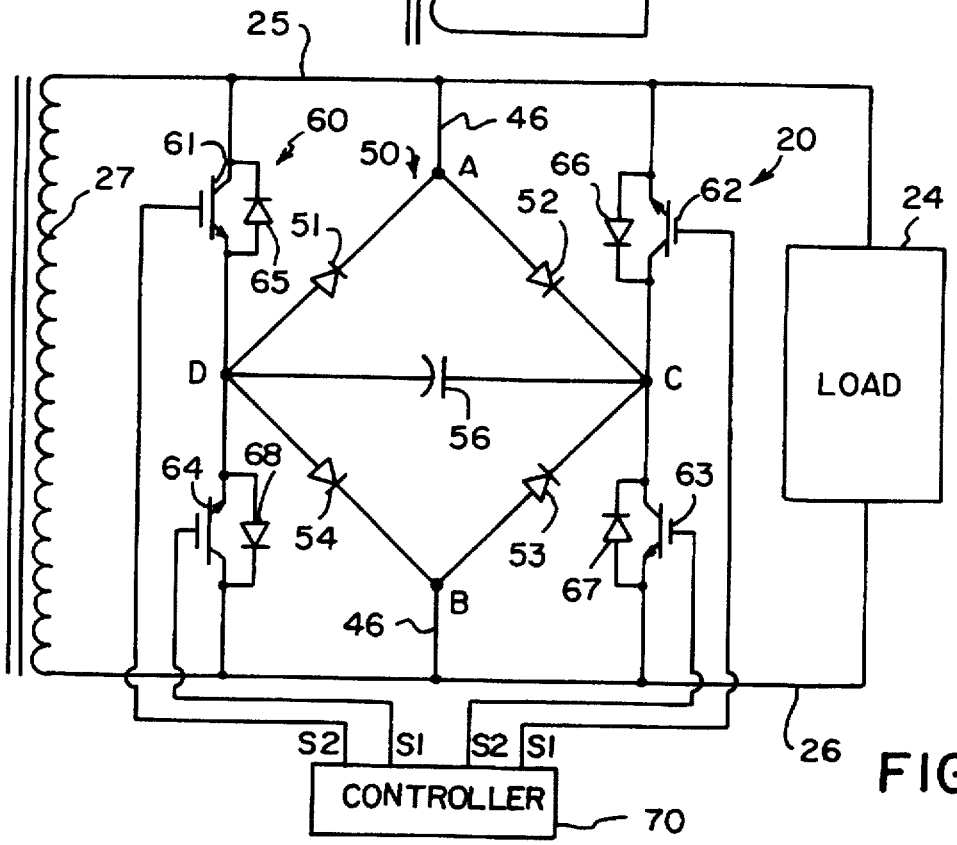
FIG. 3 is a schematic circuit diagram of a dynamic voltage regulation stabilizer system in accordance with the present invention, shown connected between the transformer output of a UPS and a load.

A circuit schematic of the basic DVR stabilizer system 20 of the present invention is shown in FIG. 3, connected between the output lines 25 and 26 of the UPS. AC power on the output lines 25 and 26 is provided on lines 46 to two AC input nodes, labeled A and B in FIG. 3, of a full wave rectifier 50 including a bridge of diodes 51, 52, 53, and 54. The diodes 51–54 may be semiconductor diodes which can readily be selected to provide the necessary power rating for the expected UPS load. The DC output nodes of the rectifier bridge 50 are labeled C and D in FIG. 3. The bridge 50 rectifies the AC input voltage on the output lines 25 and 26 to provide a full wave rectified DC output voltage between the nodes C and D. A large bulk capacitor 56 is connected across the DC output nodes C and D of the rectifier bridge 50.

An switching device bridge 60, including switching devices 61, 62, 63, and 64, connects the bulk capacitor 56 to the output lines 25 and 26 of the UPS. The bridge switching devices 61–64 may be implemented, for example, as IGBTs, including intrinsic anti-parallel connected diodes 65, 66, 67, and 68. (Note that rectification of the AC waveform on the UPS output lines 25 and 26 is accomplished by the switching device diodes 65–68 in combination with the diodes 51–54 of the bridge rectifier 50.) The bridge switching devices 61–64 are controlled by a bridge controller 70 which provides switching control signals S1 and S2 to the switching devices 61–64 to turn them on to apply the voltage on the bulk capacitor 56 to the UPS output lines 25 and 26. The controller 70 alternately turns on complimentary pairs of switching devices 62,64 or 61,63 for a selected duration encompassing the time of alternating peaks of the AC output voltage waveform on the output lines 25 and 26. Thereby, the voltage on the bulk capacitor 56 is provided to the output lines 25 and 26 in alternating polarities corresponding to the AC output voltage waveform polarities.

As will now be discussed in more detail, the rectifier bridge 50 and bulk capacitor 56 act to clamp the voltage across the output lines 25 and 26 to the normal steady state peak voltage level when the peak voltage level across the output lines exceeds the normal peak voltage level. The bridge 60 is controlled by the controller 70 to provide voltage from the bulk capacitor 56 to the output lines 25 and 26 to fill in for drops in the AC output voltage waveform when the peak output voltage level across the output lines 25 and 26 drops below the normal steady state peak output voltage level.

During normal operation of the UPS, when the output voltage is stable, the waveform of the voltage across the output lines 25 and 26 is substantially sinusoidal, with nearly equal positive and negative peaks. As the voltage across the lines 25 and 26 is full wave rectified by the rectifier 50, and applied to the bulk capacitor 56, the capacitor 56 is rapidly charged-up to nearly the steady state zero-to-peak (hereinafter the "peak") value of the voltage across the output lines 25 and 26. Since the bridge 60 is turned off between peaks of the output voltage waveform, the voltage across the bulk capacitor 56 remains at substantially the peak voltage during the time between one peak and the next peak of the full wave rectified voltage appearing across output nodes of the rectifier 50. Under normal circumstances, where the output voltage across the output lines 25 and 26 is substantially constant in peak magnitude, the voltage across the bulk capacitor 56 back biases the rectifier diodes 51–54 at essentially all times, except, perhaps, for a short period of time around the peak of each half-cycle, during which the capacitor 56 is re-charged to the peak voltage level to replace energy lost from the capacitor by discharge through the minimal inherent or other system resistances associated with the DVR stabilizer system 20. Also, under normal circumstances, since the voltage level across the output lines 25 and 26 at the peak of the AC output voltage waveform will be substantially equivalent to or greater than the voltage across the bulk capacitor 56, there will be little or no discharge of the capacitor 56 through the switching device bridge 60 to the output lines 25 and 26 when the bridge switching devices are turned on at the peaks of the AC output voltage waveform. Consequently, during normal operation, very little energy is transferred into or out of the bulk capacitor 56, and the capacitor 56 adds only a small amount of effective capacitive power factor to the load as seen by the main power system.

If the PFC load 24 begins to interact with the output winding 27 of the ferroresonant transformer, the output voltage from the transformer across the lines 25 and 26 may rapidly increase or decrease as the transformer attempts to maintain the current level flowing to the load 24 and the load 24 attempts to maintain unity power factor. If such interaction between the UPS transformer and the load 24 causes the peak value of the voltage across the output lines to exceed the voltage on the capacitor 56, the rectifier 50 will conduct, diverting sufficient current through the capacitor 56 to clamp the voltage across the output lines 25 and 26 at substantially the capacitor voltage, i.e., the normal steady state peak voltage level. Since the capacitor 56 is relatively large, the voltage across the capacitor 56 will increase relatively little during each such cycle of charging. If the interaction between the UPS transformer and the load 24 causes the peak value of the voltage across the output lines 25 and 26 to drop below the voltage on the capacitor 56, the capacitor 56 will discharge through the switching device bridge 60, which is turned on for a selected duration encompassing the time of the peak of each half-cycle of the AC voltage waveform, thereby holding up the voltage across the output lines 25 and 26 to fill in the voltage drop by raising the peak output voltage to the normal steady state peak voltage level. Since the capacitor 56 is relatively large, the voltage across the capacitor 56 will decrease relatively little during each such cycle of discharging. By clipping overshoots of the peak of the output voltage waveform, and filling in voltage undershoots of the peak of the output voltage waveform, in this manner, a DVR stabilizer system 20 in accordance with the present invention rapidly eliminates the feedback mechanism between the transformer and load 24 which causes oscillations on the output lines 25 and 26. If oscillation on the output lines 25 and 26 has begun, the damping provided by the DVR stabilizer system 20 will stop the oscillatory activity.

The operation of the DVR stabilizer system 20 illustrated in FIG. 3 is further explained with reference to the waveform diagram of FIG. 4. Waveform 72 illustrates three half-cycles of an AC output voltage waveform on the UPS output lines 25 and 26. Waveform 74 illustrates the switching control signals S1 that are provided from the bridge controller 70 to switching devices 62 and 64 in the bridge 60. Waveform 76 illustrates the switching control signals S2 that are provided from the bridge controller 70 to switching devices 61 and 63 in the bridge 60. When the switching control signals S1 or $2 are active, the selected switching devices 62, 64 or 61, 63 are turned on. Waveform 78 illustrates the current flowing through the bulk capacitor 56.

Assume that the bulk capacitor 56 has previously been charged to approximately the normal steady state peak voltage level by an extended period of normal operation. During the first half-cycle of the exemplary AC output voltage waveform 72 illustrated in FIG. 4, conditions on the output lines 25 and 26 of the UPS would, in the absence of DVR stabilization, cause the peak output voltage, illustrate by dashed line 80, to exceed the normal steady state peak voltage level. However, at the point where the voltage level on the output lines 25 and 26 exceeds the normal steady state peak voltage level stored on the bulk capacitor 56, the diodes 52 and 54 in the diode bridge 50 become forward biased, thereby clamping the peak output voltage 72 to the normal steady state peak voltage level by diverting a charging current 78 from the output lines 25 and 26 into the bulk capacitor 56. During the peak of this exemplary half-cycle, the bridge switching devices 62 and 64 are turned on for a selected duration by switching control signal S1, thereby connecting the bulk capacitor 56 across the output lines 25 and 26. However, since the peak output voltage level on the output lines 25 and 26 is greater than the voltage stored on the bulk capacitor 56, there is no conduction through the switching devices 62 and 64 during this half-cycle.

During the second half-cycle of the exemplary AC output voltage waveform 72, the peak output voltage level, illustrated by dashed line 82, which would be provided across the output lines 25 and 26 in the absence of DVR stabilization, is less than the normal steady state peak output voltage level. However, for a selected duration encompassing he time of the time of the peak of this half-cycle, the controller 70 provides switching control signal S2 to turn on switching devices 61 and 63 in the bridge 60. This connects the bulk capacitor 56 across the output terminals 25 and 26 of the UPS and, since the voltage applied to the output terminals 25 and 26 from the transformer winding 27 is less than the voltage across the capacitor 56, a discharge current 78 flows from the capacitor 56 to the output lines 25 and 26 to thereby raise the peak output voltage to the steady state voltage level and fill in the voltage undershoot. Note that during this half-cycle, switching devices 61 and 63 are turned on to connect the bulk capacitor voltage to the output lines 25 and 26 in the opposite polarity from when the switching devices 62 and 64 were turned on to connect the bulk capacitor voltage to the output lines 25 and 26 during the previous half-cycle. During a positive half-cycle of the output voltage waveform, the bridge 60 is controlled to apply the bulk capacitor voltage in a positive polarity to the output lines 25 and 26. During a negative half-cycle of the output voltage waveform, the bridge 60 is controlled to apply the bulk capacitor voltage in a negative polarity to the output lines 25 and 26.

Figure 4:
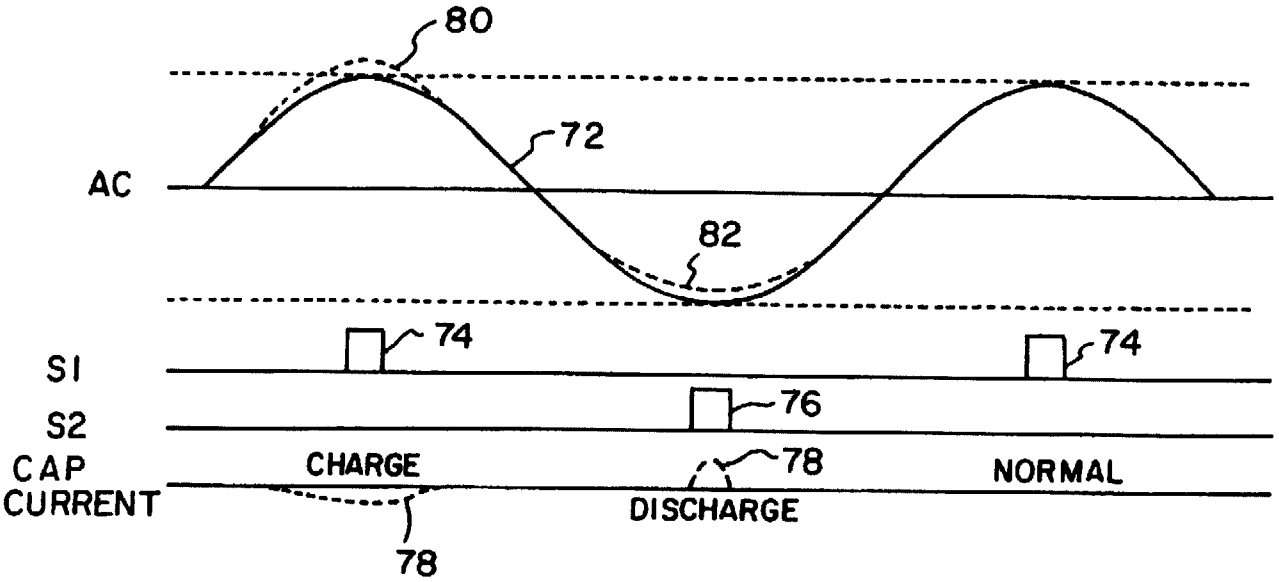
FIG. 4 is a waveform diagram illustrating the operation of the dynamic voltage regulation stabilizer system of FIG. 3.

During the third half-cycle of the exemplary AC output voltage waveform 72 illustrated in FIG. 4, the peak output voltage level applied to the output lines 25 and 26 is approximately the normal steady state peak output voltage level. During this positive half-cycle, the bridge controller 70 once again provides switching control signal S1 to turn on switching devices 62 and 64 in the bridge 60 for a selected duration encompassing the time of the peak of the half-cycle. However, since the peak output voltage level on the output lines 25 and 26 is substantially equal to the voltage across the bulk capacitor 56, no discharge current flows out of the capacitor 56 through the bridge switching devices 62 and 64, and the diode bridge 50 is back-biased so no charging current flows into the capacitor 56 through the rectifier bridge 50.

Figure 5:
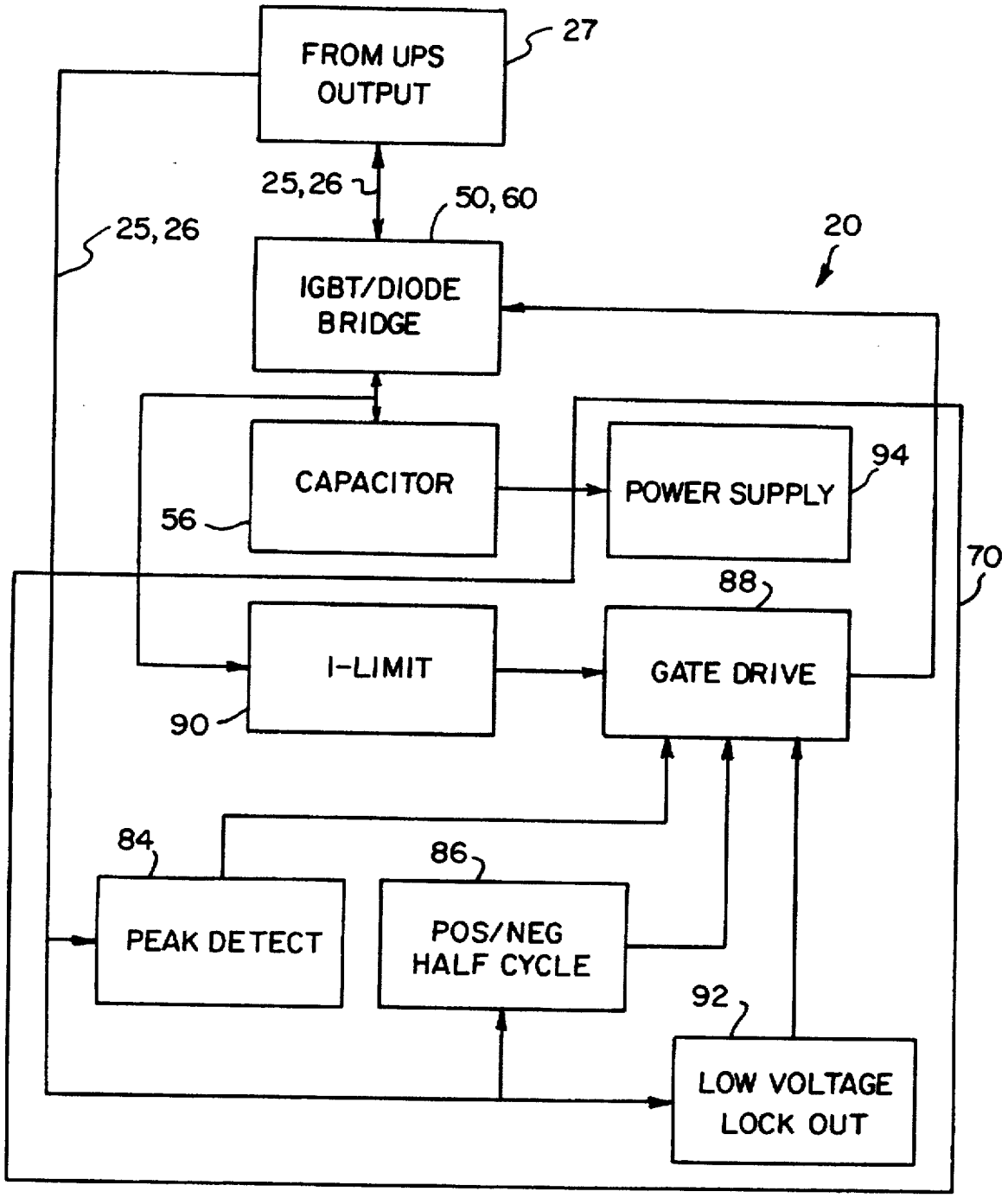
FIG. 5 is a block diagram illustrating the functional components of a controller for controlling the bridge switching devices employed in a dynamic voltage regulation stabilizer system in accordance with the present invention.

Preferred operational functions implemented in a controller 70 for a DVR stabilizer system 20 in accordance with the present invention are described with reference to the schematic block diagram of FIG. 5. The DVR stabilizer system 20, including diode bridge 50, switching device bridge 60, bulk capacitor 56, and controller 70, is connected to the output lines 25 and 26 from the output winding 27 of the UPS transformer, in parallel with a load (not shown in FIG. 5). As described previously, the UPS output waveform is rectified through the diode bridge 50 and the capacitor 56 is thereby charged to the normal steady state peak output voltage level. At this point, the DVR stabilizer system 20 can provide dynamic voltage regulation of the UPS output. Selected switching devices, e.g., IGBTs, in the bridge 60 are turned on for a selected duration encompassing the time of the peaks of the output voltage waveform to allow the capacitor 56 to discharge onto the UPS output lines 25 and 26 to fill in peak output voltage drops. As described previously, although selected switching devices are turned on at the peak of every half-cycle, the capacitor 56 will discharge only if the peak output voltage on the output lines 25 and 26 is below the voltage level on the capacitor 56, which is charged to the normal steady state peak output voltage level. The peak output voltage level on the output lines 25 and 26 is prevented from rising above the normal steady state peak output voltage level stored on the capacitor 56 by conduction of the diode bridge 50.

Selected bridge switching devices are turned on for a selected duration encompassing the time of the peak of each half-cycle of the output voltage waveform by switching control signals provided by the bridge controller 70. The controller 70 preferably includes a peak detection system 84, which monitors the output voltage waveform on the output lines 25 and 26, and which provides a peak detection signal for a selected duration encompassing the time of the peak of the AC output voltage waveform. The peak detection signal defines when, and for how long, selected switching devices in the bridge 60 are to be turned on. The controller 70 also preferably includes a positive/negative half-cycle detection system 86. The positive/negative half-cycle detection system 86 also monitors the output voltage waveform on output lines 25 and 26, and provides positive and negative half-cycle detection signals which indicate whether the output voltage waveform is in a positive or negative half-cycle. The peak detection signal and the positive and negative half-cycle detection signals are combined to yield positive half-cycle peak detection and negative half-cycle peak detection signals which are provided to a gate drive circuit 88. The gate drive circuit 88 responds to the positive and negative half-cycle peak detection signals by providing switching control signals to the bridge 60 to turn on selected switching devices in the bridge 60 to connect the bulk capacitor voltage across the output lines 25 and 26, in alternating positive and negative polarities, for a selected duration, encompassing the time of the positive and negative peaks, respectively, of the AC output voltage waveform.

The bridge controller 70 preferably also includes systems that prevent the bridge switching devices from being turned on under certain abnormal operating conditions, to thereby prevent the bridge switching devices from being damaged due to such conditions. A current limit system 90 is preferably provided to prevent the bulk capacitor current discharging through the bridge switching devices from exceeding the current rating of the switching devices, and hence damaging or destroying them. The current limit system 90 monitors the capacitor discharge current through the bridge switching devices. If the capacitor current through the bridge switching devices exceeds a current limit threshold level, the current limit system 90 provides a current limit signal to the gate drive circuit 88. The gate drive circuit 88 responds to the providing of the current limit signal by disabling turn on of the bridge switching devices.

A low voltage lock out system 92 is preferably provided to prevent the bridge switching devices from being turned on when the potential between the instantaneous voltage level on the UPS output lines 25 and 26 and the voltage stored on the bulk capacitor 56 is too high. The low voltage lock out system 92 monitors the instantaneous voltage level across the output lines 25 and 26, and provides a low voltage lock out signal to the gate drive circuit 88 when the instantaneous output voltage level is below a selected low voltage threshold level. The low voltage lock out signal prevents the gate drive circuit 88 from turning on the bridge switching devices under low voltage conditions. This prevents damage to the bridge switching devices from occurring if the peak detection system false triggers either during system startup, or during a shorted output condition. Since high current discharge of the capacitor 56 through the bridge switching devices is prevented from occurring under such conditions, damage to the bridge switching devices is avoided.

The bridge controller 70 is preferably provided with power from an independent power supply 94, which derives power for the controller 70 from the energy stored on the large bulk capacitor 56. For a controller 70 implemented using conventional analog and/or digital circuit components, for example, the power supply 94 may provide a nominal 15 volt output that powers all of the controller drive, detection, and protection systems.

An exemplary preferred implementation of a DVR stabilizer system 20 in accordance with the present invention, including bridge controller 70, is illustrated in and described with reference to the schematic circuit diagrams of FIGS. 6, 7, 8, and 11. This exemplary embodiment of a DVR stabilizer system 20 is implemented using conventional commercially available discrete and/or integrated circuit analog components. It should be noted, however, that a DVR stabilizer system in accordance with the present invention may be implemented in various manners, using various combinations of analog and/or digital circuit components.

For example, the bridge switching, peak and positive/negative half-cycle detection, and switching device protection functions, of the controller 70, may be implemented using a conventional programmable microprocessor, or a similar digital or software controlled system.

Figure 6:
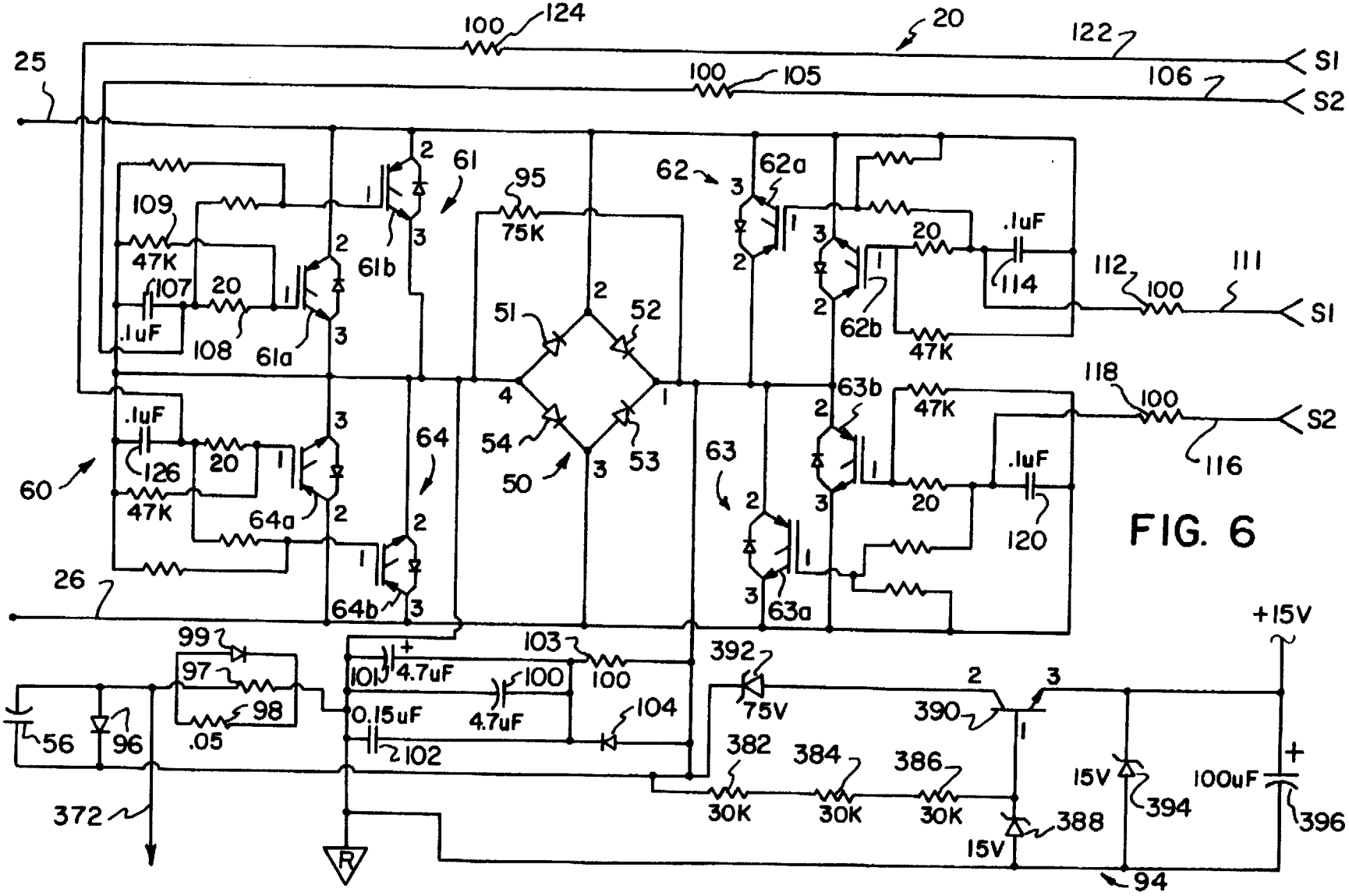
FIGS. 6, 7, 8, and 11 are schematic circuit diagrams illustrating an exemplary implementation of a dynamic voltage regulation stabilizer system in accordance with the present invention.

A diode bridge rectifier 50 and switching device bridge 60 for the exemplary implementation of the DVR stabilizer system 20 are illustrated in FIG. 6. The diode bridge 50, including diodes 51–54, may be preferably implemented using a diode bridge chip. The diode bridge 50 is connected between the output lines 25 and 26 and the bulk capacitor 56. A large, e.g., 75K ohm, resistor 95 may be connected across the diode bridge 50, in parallel with the bulk capacitor 56. The resistor 95, which provides a very slow discharge path for the bulk capacitor 56, is provided to deal with potential safety concerns, by ensuring complete discharge of the large bulk capacitor 56 when the power supply system is inactive. The resistor 95 is sized such that there is only minimal discharge of the bulk capacitor 56 between half-cycles of the AC voltage waveform on the lines 25 and 26.

As described previously, the bulk capacitor 56, which is connected across the DC output nodes of the diode bridge 50, provides clipping of the voltage level on the output lines 25 and 26 when the peak voltage level exceeds the capacitor voltage, and fills in for voltage drops when the peak voltage level on the output lines 25 and 26 falls below the voltage level on the capacitor 56. A diode 96 is connected across the capacitor 56 to prevent reverse biasing of the electrolytic bulk capacitor 56 if one of the diodes in the diode bridge 50 or one of the switching devices in the switching device bridge 60 should fail. Thus, the diode 96 prevents an AC line voltage on the output lines 25 and 26 from being applied to the DC capacitor 56. Resistors 97 and 98 and diode 99 form part of a current limit system 90 which is used to prevent switching on of the bridge switching devices in the presence of large capacitor currents which might damage the switching devices. The current limit system 90 will be discussed in more detail below.

The voltage across the bulk capacitor 56 is filtered by capacitors 100–102. These capacitors filter out any inductive kick from the leads of the bulk capacitor 56. Resistor 103 and diode 104 prevent excessive capacitor heating that may be caused by exceeding the ripple current rating of the capacitors 100–102. Diode 104 allows the capacitors 100–102 to attenuate the inductive kick of the bulk capacitor leads. Resistor 103 limits the discharge current (ripple current) from the small filter capacitors 100–102.

In the exemplary implementation of the DVR stabilizer system 20, the bridge switching devices 61–64 are each implemented by two parallel IGBTs 61*a,b*, 62*a,b*, 63*a,b*, and 64*a,b*. The use of multiple parallel bridge switching devices enhances system redundancy and increases the current carrying capability of the DVR stabilizer system 20. Thus, higher power systems may require more parallel switching devices in the bridge 60, depending on the rating of the switching devices used. Note that each IGBT includes an intrinsic anti-parallel connected diode. These diodes act in combination with the diodes 51–54 in the diode bridge 50 to provide rectification of the AC signal on the output lines 25 and 26, to thereby provide a DC charging current to the bulk capacitor 56 when the instantaneous absolute voltage level on the lines 25 and 26 exceeds the voltage level on the capacitor 56.

The IGBTs forming the bridge 60 turn on and off in response to gate drive signals applied to the gates of the IGBTs 61–64*a,b*. Gate drive circuitry for the IGBTs will be described initially for IGBT 61*a*. The gate drive circuitry provides a delay to slow down the turn-on and turn-off of the IGBTs in response to the switching control signals provided by a gate drive circuit 88. This delay prevents a quick turn-off of the IGBTs, which may cause sudden changes in the UPS transformer currents, resulting in large flyback voltages. The delay circuit for IGBT 61*a* includes a resistor 105 on the line 106 which carries the switching control signals to the IGBT 61*a*, and a capacitor 107. Resistor 108 dampens any gate oscillations on the IGBT 61*a*. Resistor 109 acts as a pull-down resistor, preventing a floating gate on the IGBT 61*a*. IGBT 61*b* is connected in parallel with IGBT 61*a*, and is responsive to the same switching control signals applied on line 106. The resistor 105 and capacitor 107 therefore also provide a turn-on/turn-off delay circuit for IGBT 61*b*. However, IGBT 61*b* has its own pull-down resistor and its own gate resistor for dampening oscillations. IGBTs 62*a* and 62*b* are turned on and off by switching control signals applied on line 111. A gate drive delay circuit including resistor 112 and capacitor 114 is also provided for IGBTs 62*a* and 62*b*. Similarly, IGBTs 63*a* and 63*b* are turned on and off by switching control signals on line 116, and are provided with a gate drive delay circuit including resistor 118 and capacitor 120. Finally, IGBTs 64*a* and 64*b* are turned on and off by switching control signals applied on line 122, and are provided with a gate drive delay circuit including resistor 124 and capacitor 126. Each IGBT in the bridge 60 also has an associated pull-down resistor and gate resistor which perform the same functions for those IGBTs as resistors 109 and 108, respectively, perform for IGBT 61*a*.

Figure 7:
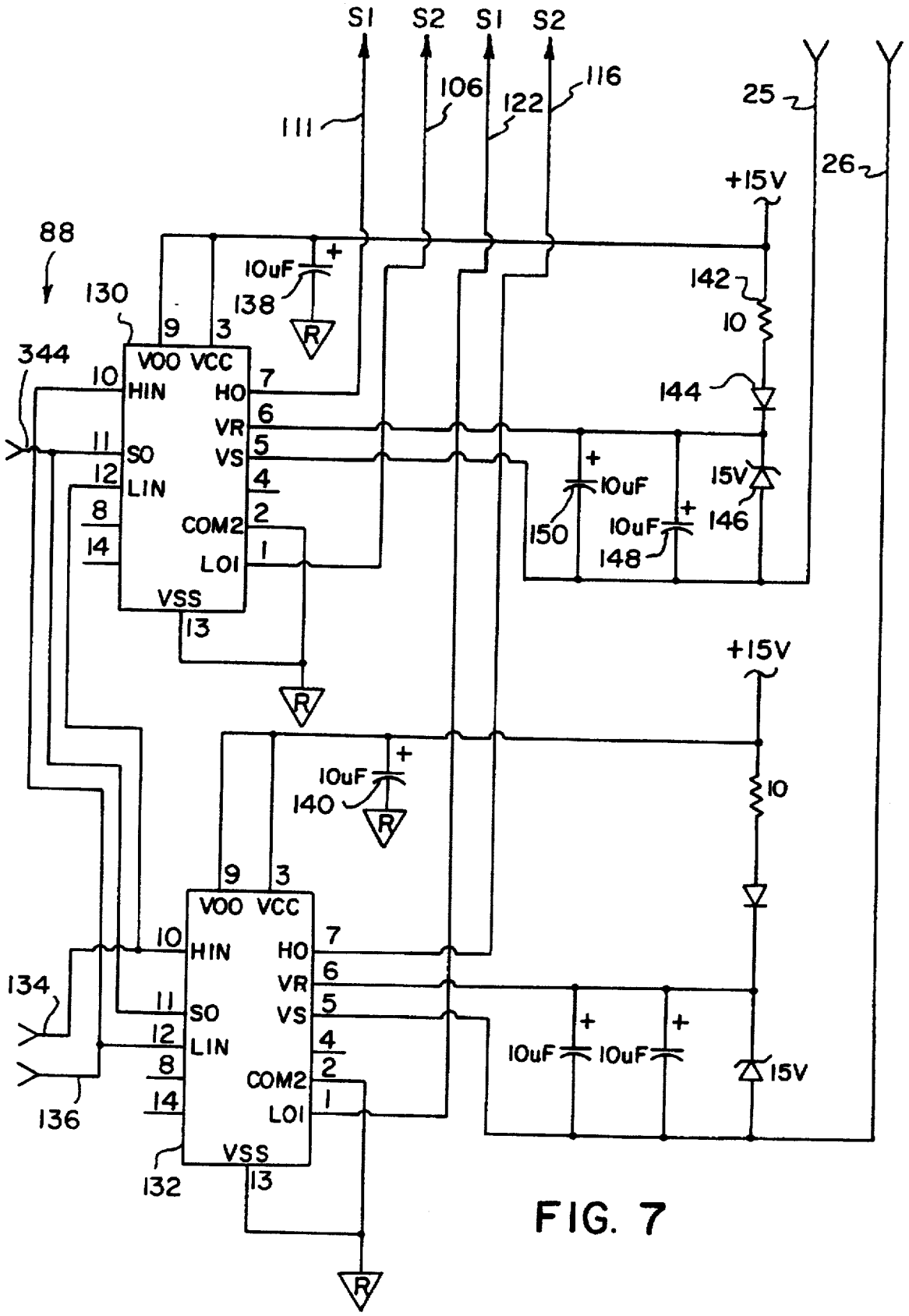

The IGBT switching devices 61–64*a,b* are turned on by switching control signals provided on the lines 106, 111, 116, and 122 from a gate drive circuit 88. An exemplary implementation of the gate drive circuit 88 is illustrated in FIG. 7. The gate drive circuit 88 includes two bridge switching device driver chips, 130 and 132, e.g., IR2110 integrated circuit half bridge driver chips, which provide the switching control signals on the lines 106, 111, 116, and 122 to the bridge switching devices. The driver chips 130 and 132 boost positive and negative half-cycle peak detection signals, that are provided on lines 134 and 136 from peak detection 84 and positive/negative half-cycle detection 86 circuits, into the higher current switching control signals needed for turning on the bridge IGBTs. Capacitors 138 and 140 are decoupling capacitors for the driver chips 130 and 132.

Each driver chip 130 and 132 preferably has its own bootstrap power supply. For example, driver chip 130 has a bootstrap power supply including resistor 142, diode 144, zener diode 146, and paralleled capacitors 148 and 150. The diode 144 provides a one-way charging path from the system power supply, at, e.g., 15 V, to charge up the capacitors 148 and 150. Resistor 142 provides a charging current limit. Diode 144 prevents the capacitors 148 and 150 from discharging into the power supply when the ground potential rises above the 15 V supply. The zener diode 146, e.g., an 18 V zener, provides overvoltage protection for the bootstrap power supply. The bootstrap power supply for the other driver chip 132 is similar, and hence is not described in further detail herein. The bootstrap power supplies allow one 15 volt power supply to drive systems running off of different grounds.

Figure 8A:
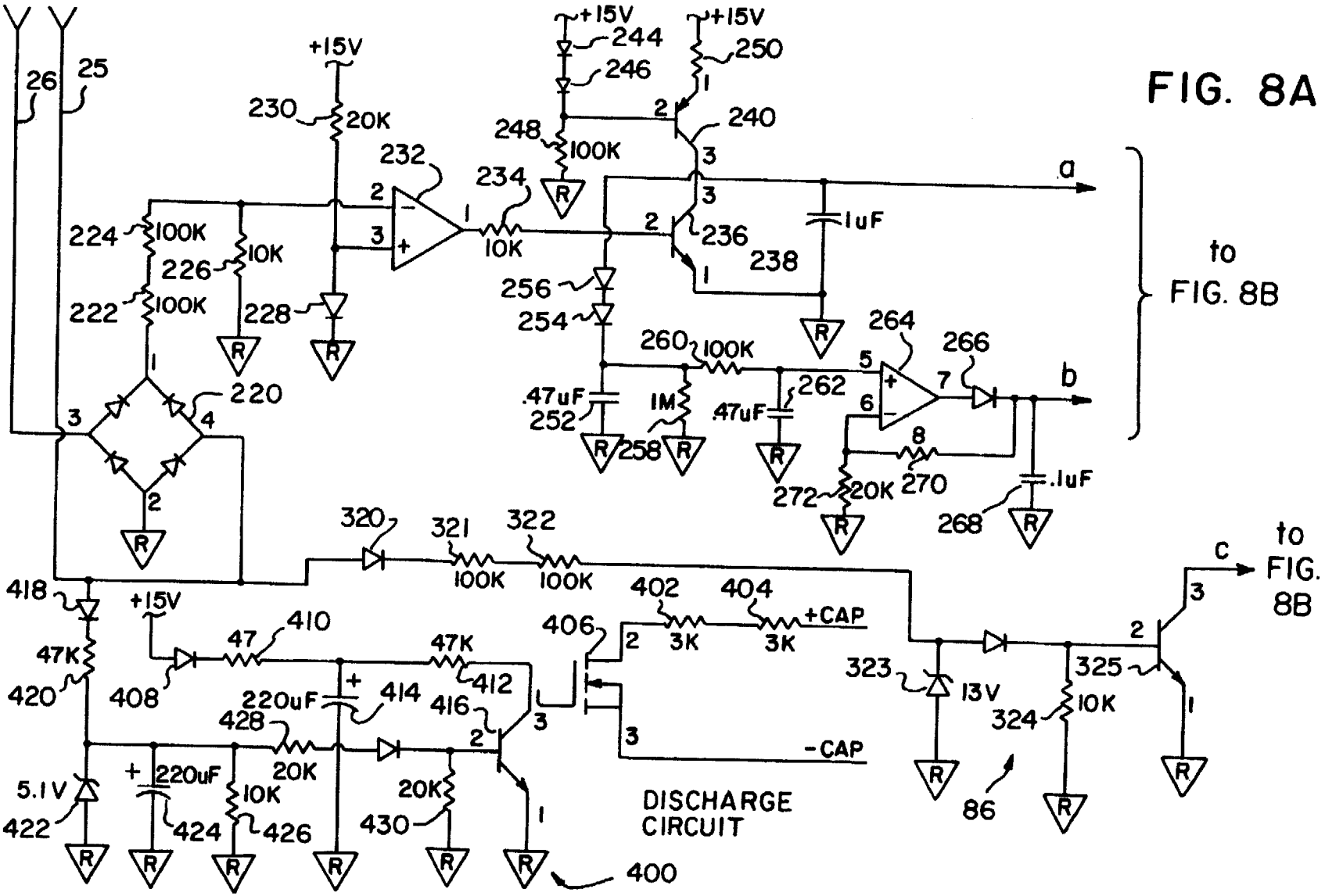
Figure 8B:
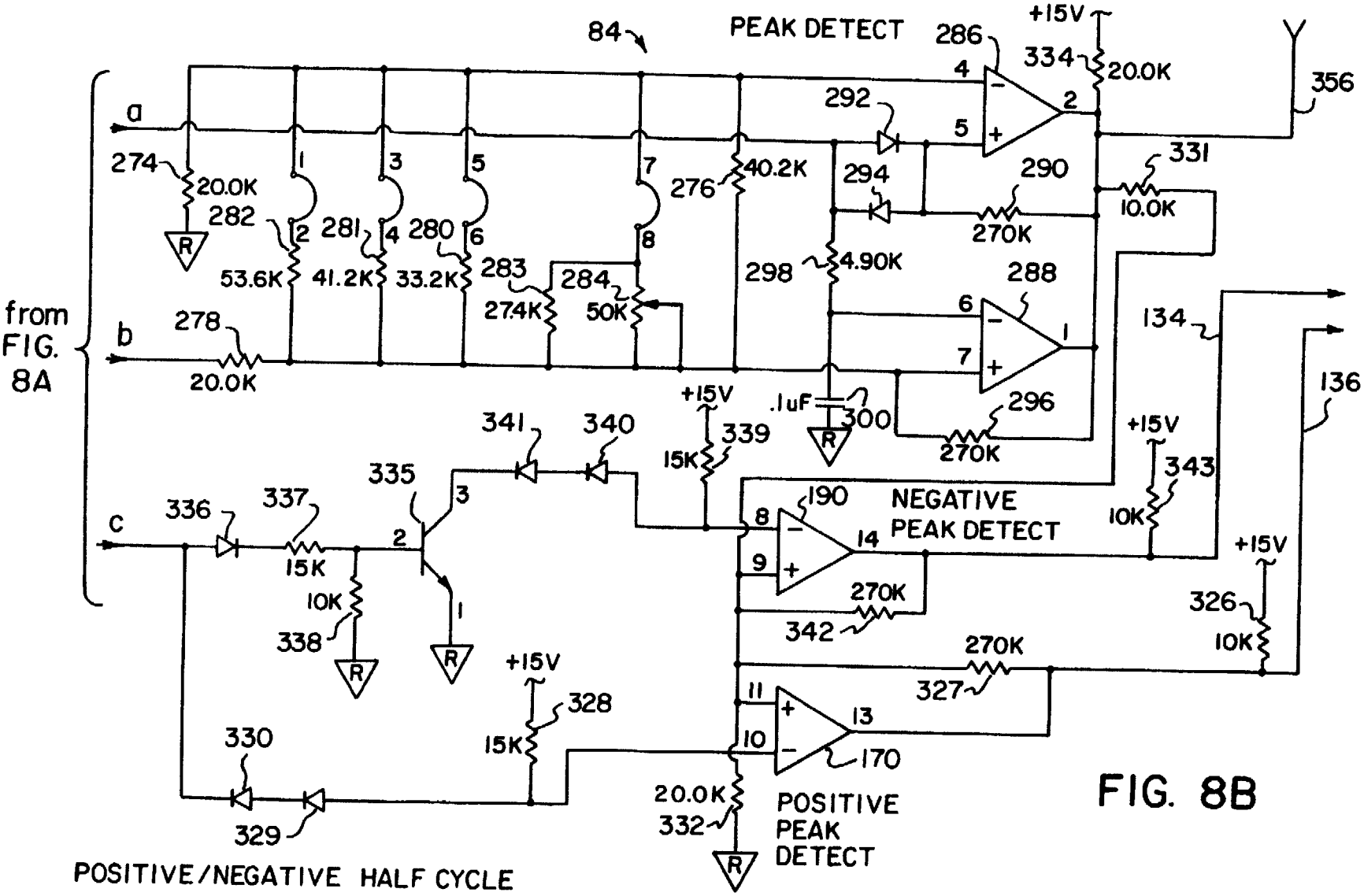

Exemplary implementations of a peak detection system 84 and a positive/negative half-cycle detection system 86 are described with reference to the schematic circuit diagram of FIG. 8. The peak detection system 84 and positive/negative half-cycle detection system 86 combine to provide positive half-cycle peak detection and negative half-cycle peak detection signals on lines 134 and 136 to the gate drive circuit 88. The positive half-cycle peak detection and negative half-cycle peak detection signals define which bridge switching devices will be turned on, when the bridge switching devices will be turned on, and the duration for which the bridge switching devices will be turned on. The circuit illustrated in FIG. 8 provides essentially a logical AND function for positive and negative half-cycle detection signals provided by the positive/negative half-cycle detection circuit 86 and peak detection signals provided by the peak detection circuit 84. For a positive half-cycle peak detection signal to be provided to the gate drive circuit 88, the output of the peak detection circuit 84 must be high, indicating that the half-cycle of the waveform on the lines 25 and 26 is at or near the peak, and a positive half-cycle detection signal from the positive/negative half-cycle detection circuit 86 must be active. For a negative half-cycle peak detection signal to be provided to the gate drive circuit 88, the peak detection signal provided by the peak detection system 84 must be active, indicating that the half-cycle of the waveform on the lines 25 and 26 is at or near the peak, and a negative half-cycle detection signal from the positive/negative half-cycle detection system 86 must be active.

The exemplary peak detection circuit 84 illustrated in FIG. 8 uses the zero-cross of the voltage waveform on the lines 25 and 26 to reset a ramp voltage generator. During the half-cycle of the output voltage waveform, the ramp voltage increases linearly. The peak level of the ramp voltage, stored in a capacitor, is divided into two threshold voltage levels by a resistor divider network. When the ramp voltage exceeds the lower ramp voltage threshold level, the peak detection signal is activated. When the ramp voltage exceeds the higher ramp voltage threshold level, the peak detection signal is turned off. The low and high ramp voltage threshold levels thus establish the timing and duration of the peak detection signal during the half-cycle. During the period when the peak detection signal is active, one of a positive or negative half-cycle peak detection comparator 170 or 190 is turned on, thereby providing a positive half-cycle or negative half-cycle peak detection signal to the gate drive circuit 88, causing selected ones of the bridge switching devices to be turned on.

The AC voltage waveform on the lines 25 and 26 is rectified by a diode bridge rectifier 220. The output of the diode bridge rectifier 220 is a full wave rectified sinusoidal waveform corresponding to the waveform on lines 25 and 26. A zero-cross detection signal is derived from the rectified waveform provided by the diode bridge 220. The zero-cross detection signal is, in turn, used to reset a ramp voltage level.

The rectified AC waveform from rectifier 220 is voltage divided by voltage dividing resistors 222, 224, and 226. The voltage divided rectified waveform is compared with a fixed 0.7 volt reference, obtained from diode 228 and resistor 230, at comparator 232. The output of the comparator 232 goes high whenever the resistor divided rectified voltage waveform falls below the fixed 0.7 volt reference. Thus, the output of the comparator 232 is a zero-cross detection signal which goes high at each zero-cross of the AC voltage waveform on the output lines 25 and 26.

A voltage ramp is provided by a constant current source charging a ramp capacitor 238. The constant current flow into the capacitor generates a very linear voltage ramp during the half-cycle. The ramp voltage is reset at every zero-cross of the AC voltage waveform on the lines 25 and 26 by discharging the capacitor 238 in response to the zero-cross detection signal provided by the comparator 232. The zero-cross detection signal is current limited by resistor 234 and applied to the gate of a transistor 236. Transistor 236 is connected across the ramp capacitor 238. At a zero-cross of the waveform on lines 25 and 26 the output of comparator 232 goes high, turning transistor 236 on, thereby shorting the ramp capacitor 238 to ground. Thus, the ramp capacitor 238 discharges rapidly, and the ramp voltage level is reset, at each zero-cross of the AC voltage waveform on the output lines 25 and 26.

The constant current source for the voltage ramp is provided by transistor 240. A fixed 13.6 volt reference is applied to the base of the transistor 240 by diodes 244 and 246 and resistor 248. (The 15 volt supply minus 0.7 volt drops across each of the diodes 244 and 246 gives the 13.6 volt reference.) The transistor 240 is a p-channel device, so the emitter must be 0.7 volts above the base for the transistor 240 to turn on. This leaves 0.7 volts applied across the resistor 250 between the power supply and the emitter of the transistor 240. The 0.7 volts across the resistor 250 cannot vary. Any attempt at drawing more current through the transistor 240 would cause an additional voltage drop across the resistor 250. However, additional voltage cannot appear across resistor 250, since that would turn the p-channel transistor 240 off. Thus, any change in current through the transistor 240 will be resisted by the transistor impedance. A constant current is thus generated through the transistor 240, and is applied to the ramp capacitor 238, to provide a linear voltage ramp signal during the output voltage waveform half-cycle.

The peak of the voltage ramp signal on the ramp capacitor 238 charges up capacitor 252 through diodes 254 and 256. A large resistor 258 is connected in parallel with capacitor 252 to provide an extremely slow discharge path for capacitor 252. Thus, capacitor 252 is essentially charged to and remains at the peak ramp voltage level on the ramp capacitor 238, less the voltage drop across the diodes 254 and 256. The voltage drop across the two diodes 254 and 256 ensure that peak detection is slightly leading. Peak detection is preferably skewed to be slightly leading, since some PFC loads that may be connected to the output lines 25 and 26 prefer a slightly leading firing of the IGBTs in the bridge 60. Lagging peak detections tend to cause ringing on the output lines 25 and 26 with some such PFC loads. A second RC network, including resistor 260 and capacitor 262, is preferably used to prevent any sudden line frequency shifts, which may occur due to surge loading, shorts, etc., from charging the ramp voltage peak to a high voltage level that takes a substantial number of cycles to dissipate. Thus, the additional RC network prevents skewed peak detections following such line frequency shifts. Amplifier 264 provides a buffer, drawing very little current from the capacitor 262, and provides sufficient current for establishing the ramp voltage thresholds. Diode 266, located on the output of the amplifier 264, provides a charging path for capacitor 268, but prevents the capacitor 268 from discharging back through the amplifier 264. The capacitor 268 has a discharge path through resistors 270 and 272.

Resistors 274, 276, and 278 form a voltage divider for establishing the high and low ramp voltage threshold levels. Resistors 274 and 278 are matched resistances which are selected to ensure that the peak detection signal remains centered in time around the occurrence of the peak of the waveform on lines 25 and 26, regardless of the pulse width of the peak detection signal. The pulse width of the peak detection signal may be varied by adding a resistor 280, 281, 282, 283, or 284, in parallel with resistor 276. This changes the voltage drop across the resistor 276, thereby changing the difference between the high and low ramp voltage threshold levels, and hence the duration of the peak detection signal. As the duration of the peak detection signal is increased or decreased, the length of time during each half-cycle when bridge switching devices are turned on is also increased or decreased.

The high and low ramp voltage threshold levels are taken off of each end of the resistor 276. One end of the resistor 276 is connected to the inverting input of a comparator 286 to establish the low ramp voltage threshold level. The other end of resistor 276 is connected to the non-inverting input of comparator 288 to establish the high ramp voltage threshold level. The ramp voltage across the ramp capacitor 238 is applied to the non-inverting input of comparator 286 and the inverting input of comparator 288.

Activation of the peak detection signal is accomplished by comparator 286. When the ramp voltage level applied to the non-inverting input of comparator 286 exceeds the low ramp voltage threshold level applied to the inverting input of comparator 286, the comparator 286 turns on, thereby applying the peak detection signal to the positive and negative half-cycle peak detection comparators 170 and 190. Feedback of the output of comparator 286 is provided to the non-inverting input of the comparator 286, by resistor 290, to provide hysteresis. Diode 292 blocks the hysteresis feedback from affecting the ramp voltage waveform. Diode 294 provides a discharge path for the input capacitance of the comparator 286.

The peak detection signal is terminated by comparator 288. When the high ramp voltage threshold level applied to the inverting input of comparator 288 is exceeded by the ramp voltage level applied to the non-inverting input of comparator 288, the output of comparator 288 is pulled low, thereby terminating the peak detection signal that was applied to the positive and negative half-cycle peak detection comparators 170 and 190. Resistor 296 provides hysteresis for comparator 288. Resistor 298 and capacitor 300 hold up the ramp voltage signal applied to the comparator 288 to prevent a very slender peak detection signal pulse from being provided when the ramp voltage is reset. For a brief period during the discharge of the ramp voltage capacitor 238, the ramp voltage will fall below the high (turn off) ramp voltage threshold level, but will still be above the low (turn on) threshold level. The RC circuit formed by resistor 298 and capacitor 300 holds the voltage ramp input signal to the comparator 288 high during discharge of the ramp capacitor 238, to prevent a false triggering of the peak detection signal during ramp voltage reset.

Figure 9:
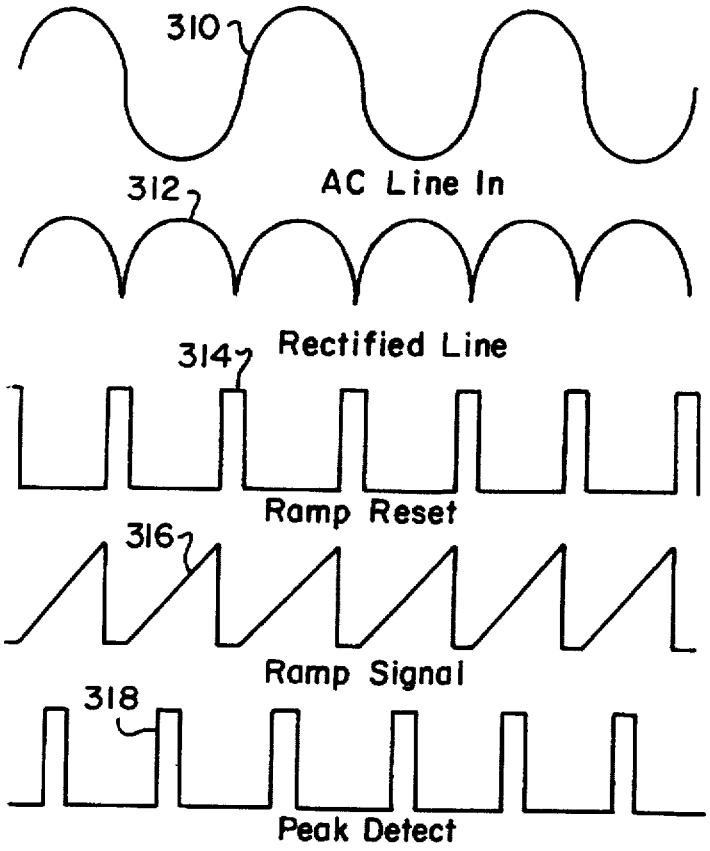
FIGS. 9 and 10 are waveform diagrams illustrating the operation of an exemplary AC waveform peak detection system for determining the turn-on time and turn-on duration of the bridge switching devices in a dynamic voltage regulation stabilizer system in accordance with the present invention.

Operation of the exemplary peak detection circuit 84 of FIG. 8 is summarized with reference to the illustrative waveform diagram of FIG. 9. Waveform 310 represents an AC voltage waveform applied to the output lines 25 and 26. The AC waveform 310 is applied across the diode bridge rectifier 220 of the peak detection circuit 84. Waveform 312 represents the full-wave rectified AC waveform signal that is provided at the output of the diode bridge rectifier 220. Whenever the voltage level of the rectified waveform 312, as divided by voltage dividing resistors 222, 224, and 226, is below the threshold voltage level applied to the non-inverting input of comparator 232, a zero-cross detection signal 314 is provided on the output of comparator 232. The zero-cross detection signal 314 acts as a ramp voltage reset signal. During the period when the zero-cross detection signal 314 is active, the transistor 236 is turned on, and the ramp capacitor 238 discharges rapidly. Thus, during the period when the zero-cross detection signal 314 is active, the ramp voltage 316 is discharged to zero volts. Once the rectified line signal 312 exceeds the zero-cross detection threshold level, the zero-cross detection signal 314 is terminated, and transistor 236 is turned off. With transistor 236 turned off, the ramp capacitor 238 is charged by the constant current level provided through transistor 240. Thus, following termination of the zero-cross detection signal, the ramp voltage signal 316 increases linearly.

Figure 10:
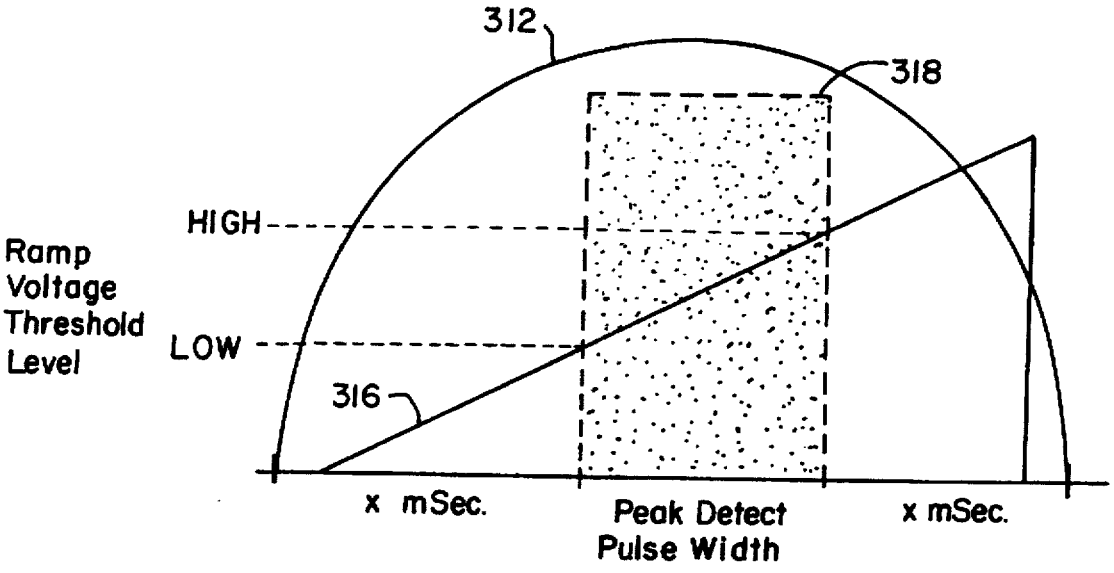

As best illustrated in FIG. 10, wherein the rectified AC voltage waveform 312, ramp voltage signal 316, and peak detection signal 318 for one half-cycle of the AC voltage waveform are overlaid, the peak detection signal 318 is activated when the ramp voltage 316 reaches a low ramp voltage threshold level, causing comparator 286 to turn on, and is terminated when the ramp voltage 316 reaches a high ramp voltage threshold level, causing the comparator 288 to turn off. The high and low ramp voltage threshold levels are established using a three resistor divider based off of the peak ramp voltage. The top 278 and bottom 274 resistors in the three resistor divider are the same value, thus ensuring the same voltage drop across them. This ensures that the peak detection signal 318 is centered near the peak of the AC voltage waveform half-cycle 312. The resistance value between the top and bottom resistors may be changed to vary the pulse width of the peak detection signal 318. Although the center resistance value is varied, the peak detection signal 318 will remain centered, assuming little or no frequency deviation from cycle to cycle of the AC voltage waveform.

The operation of the positive/negative half-cycle detection circuit 86 illustrated in FIG. 8 will now be described. This description assumes that a positive half-cycle is defined as a half-cycle of the waveform on the lines 25 and 26 during which the voltage on line 25 is above the voltage on line 26.

The input to the positive/negative half-cycle detection circuit 86 is a simple half-wave rectifier. Diode 320 half-wave rectifies the sine wave on the output line 25 of the UPS. Resistors 321 and 322 limit the current flowing through the diode 320 to the positive/negative half-cycle detection circuit 86. Zener diode 323 clamps the maximum voltage level that is provided to the positive/negative half-cycle detection circuit 86 at, e.g., 13 volts. Resistor 324 combines with resistors 321 and 322 to form a voltage divider which limits the voltage level provided to the positive/negative half-cycle detection circuit 86, and also acts as a pull-down resistor on the gate of a transistor 325.

During a positive half-cycle, the voltage on line 25 is high, causing transistor 325 in the positive/negative half cycle detection circuit 86 to turn on. This pulls the inverting input of a positive half-cycle peak detection comparator 170 low. The peak detection signal from the peak detection circuit 84 is applied to the non-inverting input of the comparator 170. When a peak detection occurs, causing the peak detection signal to go high, the non-inverting input of comparator 170 is pulled high. When the voltage level at the non-inverting input of the comparator 170 is above that at the inverting input of the comparator 170, the comparator 170 turns on, and a positive half-cycle peak detection signal is applied on line 136 to the gate drive circuit 88. This, in turn, causes the bridge switching devices 62 and 64 to be turned on by the gate drive circuit 88, allowing the voltage on the bulk capacitor 56 to discharge through the bridge onto the power lines 25 and 26 to raise the peak output voltage level to the normal peak steady state voltage level if the peak voltage level on the output lines 25 and 26 is less than the voltage across the bulk capacitor 56. The output of the comparator 170 is an open collector, thus, the output pulls low when the comparator 170 is off, but floats when the comparator 170 is on. Therefore, a pull-up resistor 326 is needed to pull the output of the comparator 170 high when the comparator 170 is on and the output should be high. Resistor 327 provides feedback and hysteresis for the comparator 170. Resistor 328 pulls the inverting input to the comparator 170 high during the negative half-cycle, when transistor 325 is turned off. Diodes 329 and 330, combined with the voltage drop across the transistor 325, provide a fixed 2.1 volts (0.7 volt drop across each of the diodes 329 and 330 and transistor 325) to the inverting input of the comparator 170 during the positive half-cycle. This ensures that a low output from the peak detection circuit 84, as applied to the non-inverting input of the comparator 170, will be below the low voltage level that is applied to the inverting input of the positive half-cycle peak detection comparator 170 during the positive half-cycle, ensuring that the comparator 170 does not turn on unless the peak detection signal is active. Resistors 331, 332 and 334 function in a similar manner with respect to the non-inverting input of the positive half-cycle peak detection comparator 170. Resistors 331, 332, and 334 voltage divide the 15 volt peak detection signal, ensuring that the non-inverting input to the positive half-cycle peak detection comparator 170 never exceeds, e.g., 6 volts. This ensures that the positive 15 volt signal that is applied to the inverting input of the positive half-cycle peak detection comparator 170 during the negative half-cycle holds off the firing of the comparator 170, to thereby hold the output of the positive half-cycle peak detection comparator 170 low during the negative half-cycle.

The generation of a negative half-cycle peak detection signal on line 134 is performed in a very similar manner to the generation of the positive half-cycle peak detection signal on line 136. During the negative half-cycle of the output voltage waveform on the lines 25 and 26, the transistor 325 is turned off, causing transistor 335 to turn on. Transistor 335 is turned on during the negative half-cycle by a 15 volt signal applied through resistor 328, diodes 329, 330, and 336, and resistor 337, to the gate of transistor 335. During the positive half-cycle, transistor 335 is turned off. Diode 336 blocks the 0.7 volt drop of transistor 325 when transistor 325 is on. Resistor 338 pulls the gate of transistor 335 to ground, turning transistor 335 off during the positive half-cycle. When transistor 335 is turned on during the negative half-cycle, the inverting input of negative half-cycle peak detection comparator 190 is pulled low through resistor 339 and diodes 340 and 341. A low voltage signal on the inverting input of negative half-cycle peak detection comparator 190 is set to 2.1 volts by the voltage drops across the diodes 340 and 341 and the transistor 335, when the transistor 335 is on and conducting. The non-inverting input of the negative half-cycle peak detection comparator 190 is connected to the output of the peak detection circuit 84. As previously described, voltage dividing resistors 331, 331, and 334, limit the voltage level at the non-inverting input of comparator 190 to a high value of 6 volts when the peak detection signal is active. When the peak detection signal is active and transistor 335 is on and conducting, the inverting input of the negative half-cycle peak detection comparator 190 will be at a lower voltage level than the non-inverting input of the comparator 190, causing the output of comparator 190 to go high, and the negative half-cycle peak detection signal to be applied on the line 134 to the gate drive circuit 88. This, in turn, will cause gate drive signals to be provided by the gate drive circuit 88 to bridge switching devices 61 and 63, thereby turning them on, and allowing the bulk capacitor 56 to discharge onto the output lines 25 and 26 to raise the voltage level on the output lines 25 and 26 to the peak steady-state level if the peak voltage level on the output lines 25 and 26 is less than the voltage level on the bulk capacitor 56. Resistor 342 provides feedback and hysteresis for the negative half-cycle peak detection comparator 190. Resistor 343 is a pull-up resistor for the output of the negative half-cycle peak detection comparator 190.

The current limit system 90 prevents damage to the IGBTs in the bridge 60 due to excessive discharge currents from the bulk capacitor 56 through the bridge 60. An exemplary current limit system 90 is described with reference to FIGS. 6 and 11. The current limit circuit 90 provides a current limit signal on the line 344 which disables the gate drive circuit 88, thereby preventing turn-on of the IGBTs in the bridge 60 when the discharge current through the bulk capacitor 56 exceeds a current limit threshold level.

Resistors 97 and 98 (FIG. 6) are current sense resistors for the current limit circuit 90. The diode 99 forms a bypass for the current sense resistors 97 and 98 for current flowing into the capacitor 56 through the diode bridge 50. The current limit system 90 only protects the bridge IGBTs, which will be in conduction when the capacitor 56 is discharging. Since the diodes in the diode bridge 50 cannot be turned off in response to the detection of an excessive capacitor charging current, there is no point in providing a mechanism for capacitor current sensing during charging of the bulk capacitor 56. The bypass diode 99 thus prevents a current limit signal from being provided by the current limit circuit 90 during charging of the bulk capacitor 56, i.e., when the peak voltage level on the lines 25 and 26 exceeds the voltage on the capacitor 56.

Resistors 345 and 346 (FIG. 11) provide a fixed bias voltage level through resistor 347 to the non-inverting input of current limit comparator 348. Resistors 349, 350, and 351 provide a current sense bias voltage level to the inverting input of the current limit comparator 348. Resistor 351 is connected to ground through the current sense resistors 97 and 98 (FIG. 6) via line 352. As the bulk capacitor 56 discharges onto the power lines 25 and 26, a current is drawn through the current sense resistors 97 and 98. This results in an offset voltage at the junction of the current sense resistors 97 and 98 and the resistor 351. Eventually, this offset voltage pulls the inverting side of current limit comparator 348 below the fixed bias level established at the non-inverting input of the current limit comparator 348. This causes the current limit comparator 348 to turn on, thereby providing a current limit signal on line 344 to the gate drive circuit 88. The current limit signal on line 344 is provided to the shutdown pins of the driver chips 130 and 132 in the gate drive circuit 88 (FIG. 7). Thus, when the current limit signal is active, indicating a high discharge current from the capacitor 56, the gate drive circuit 88 is disabled, and the IGBTs in the bridge 60 are turned off, thereby preventing damage to the IGBTs. Note that the fixed bias voltage level applied to the non-inverting input of the current limit comparator 348 is selected such that the comparator 348 provides the current limit signal when the discharge current from the bulk capacitor 56 exceeds a current limit threshold level.

Diode 353 prevents back feeding of the current limit circuit 90 from the output of the low voltage lock out circuit 92, which also provides a signal to the gate drive circuit 88 on line 344. Diode 354 latches the current limit signal on. Diode 355 provides a reset path via line 356 to the peak detection circuit 84 (FIG. 8). If the current limit signal is activated during a half-cycle of the AC waveform on the power lines 25 and 26, it will remain active until reset by the occurrence of a termination of the peak detection signal, which pulls line 356 low, thereby allowing the non-inverting input of current limit comparator 348 to return to the bias voltage level. Thus, the current limit signal is allowed to latch on whenever the peak detection signal is active, and is reset on the next falling edge of the peak detection signal. Since the IGBTs in the bridge 60 are only turned on by the gate drive circuit 88 when the peak detection signal is active, the current limit circuit 90 effectively prevents turn-on of the IGBTs in the presence of high current levels that might damage the IGBTs. When the discharge current from the capacitor 56 drops below the current limit threshold level, the voltage on the inverting input of current limit comparator 348 rises above the bias voltage level applied to the non-inverting input of comparator 348, and the current limit signal is turned off, thereby enabling the firing of the bridge IGBTs.

The peak detection 84 and positive/negative half-cycle detection 86 circuits provide positive and negative half-cycle peak detection signals to the gate drive circuit 88 which, in turn, turns on selected switching devices in the bridge 60 for a selected duration encompassing the time of the peak of each half-cycle of the AC voltage waveform on the lines 25 and 26. This allows the bulk capacitor 56 to discharge onto the lines 25 and 26 through the bridge 60 to fill in for voltage drops when the peak of the AC voltage waveform on the lines 25 and 26 is less than the voltage stored on the bulk capacitor 56. If the peak AC voltage level on the lines 25 and 26 is significantly lower than the voltage level on the capacitor 56, a high discharge current may be developed from the capacitor 56 through the IGBT switching devices in the bridge 60 when the IGBTs are turned on. This could damage the IGBTs. Therefore, a low voltage lock out system 92 is preferably provided to prevent the IGBT switching devices in the bridge 60 from being turned on when the peak line voltage is too low.

Figure 11:
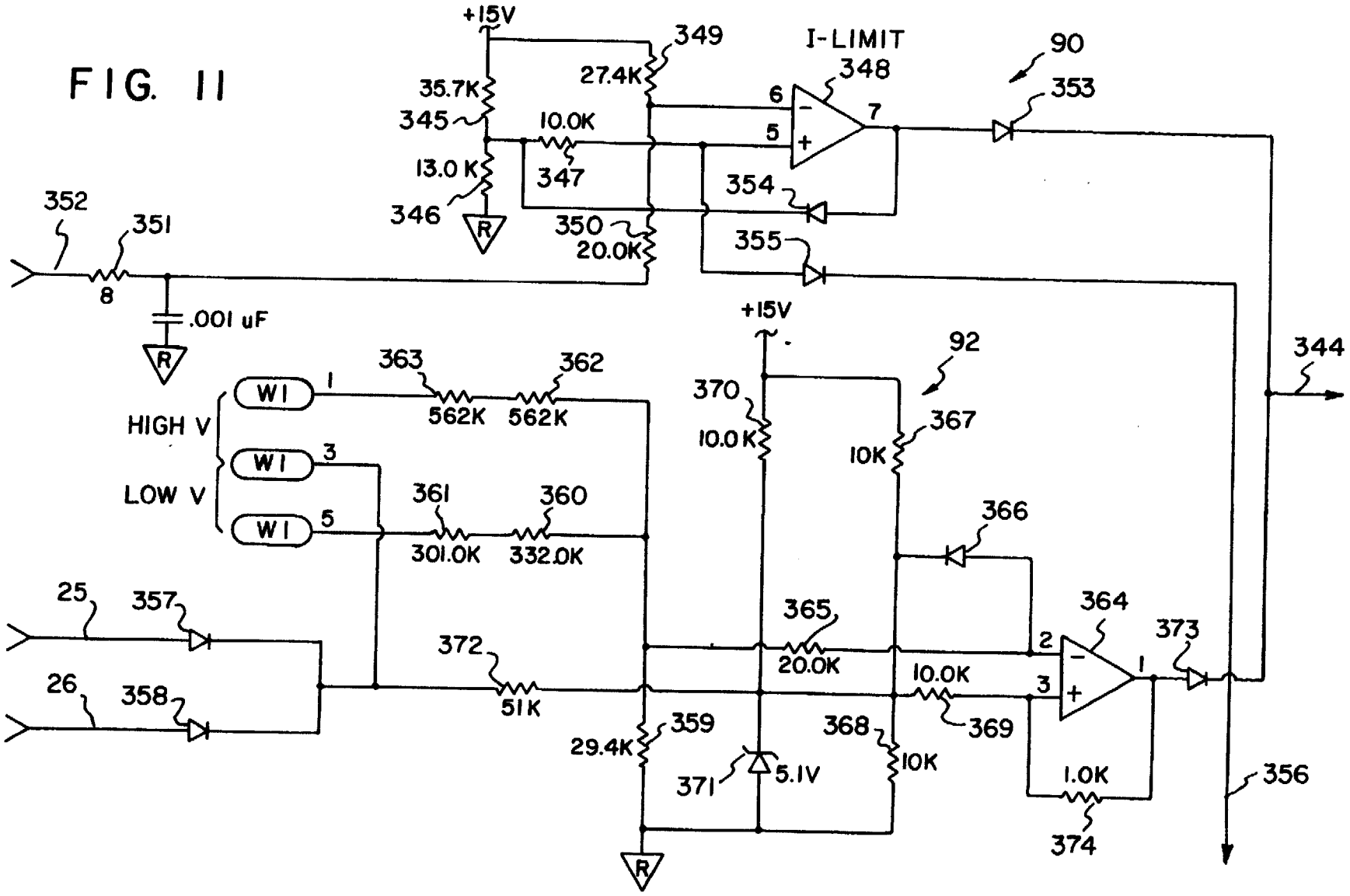

An exemplary low voltage lock out system 92 in accordance with the present invention is illustrated in FIG. 11. This exemplary circuit 92 compares the AC voltage on the output lines 25 and 26 with a relatively low fixed low voltage threshold level, and provides a low voltage lockout signal on the line 344, which disables the gate drive circuit 88, when the voltage level in the lines 25 and 26 is less than the low voltage threshold level.

Diodes 357 and 358, along with the diode bridge rectifier 50, form a full wave rectifier which rectifies the AC voltage waveform on the lines 25 and 26. The full wave rectified sine wave signal is scaled down either through resistors 359, 360 and 361 (for a low voltage DVR stabilizer system) or through resistors 359, 362 and 363 (for a high voltage system). The scaled down rectified sine wave signal is provided to the inverting input of a low voltage lock out comparator 364 through resistor 365. Diode 366 and resistors 367 and 368 limit the maximum voltage level at the inverting input of the comparator 364 to approximately, e.g., 8.2 volts, and hold the low voltage lock out signal on during system startup (when the 15 volt DVR stabilization system power supply 94 is powering up).

The non-inverting input of the low voltage lock out comparator 364 is biased at a fixed voltage level, e.g., 5.1 volts, through the resistors 369 and 370 and zener diode 371. Resistor 372 allows the 5.1 volt level to be provided to the non-inverting input of comparator 364 from the rectified AC voltage waveform, in case the 15 volt DVR stabilizer system power supply 94 does not power up during system startup.

The output of comparator 364 is connected via a diode 373 to the line 344. The diode 373 prevents back feeding of the low voltage lock out circuit 92 from the current limit circuit 90, which also provides a signal on line 344 to the gate drive circuit 88. Line 344 is connected to the shutdown pins of the driver chips 130 and 132 (FIG. 7) in the gate drive circuit 88. Resistor 374 provides feedback hysteresis for the low voltage lock out comparator 364.

Whenever the instantaneous voltage level on the output lines 25 and 26 exceeds a low voltage lock out threshold level, the inverting input of low voltage lock out comparator 364 will be higher than the non-inverting input, and the low voltage lock out signal provided on line 344 will be low, allowing the driver chips 130 and 132 to function normally to deliver gate drive signals to the bridge switching devices. However, if the voltage level on the lines 25 and 26 is low, i.e., below the low voltage threshold level, the inverting input of low voltage lock out comparator 364 will be lower than the non-inverting input of the comparator 364, causing the output of comparator 364 to go high. Thus, when the peak voltage level on the lines 25 and 26 is too low, a low voltage lock out signal will be provided on line 344 to disable operation of the driver chips 130 and 132, preventing gate drive signals from being applied to the bridge switching devices, thereby preventing the switching devices from being turned on, and thus from being damaged by a rapid discharge of the bulk capacitor 56 through the bridge when the voltage level on the capacitor 56 is much greater than the peak voltage level on the lines 25 and 26.

Power for operation of the exemplary DVR stabilizer system being described is preferably derived from the stored voltage level across the bulk capacitor 56. An exemplary 15 volt power supply 94 for the exemplary DVR stabilizer system 20 is illustrated in FIG. 6. The power supply 94 is connected between the positive terminal of the bulk capacitor 56 and ground. Resistors 382, 384, and 386 limit the current from the bulk capacitor 56 through a 16 volt zener diode 388. The bias voltage established across the zener diode 388 turns on a transistor 390. Zener diodes 392 and 394 limit the voltage drop across the transistor 390. Current from the bulk capacitor 56 flows through zener diode 392 and transistor 390 to charge a power supply capacitor 396 to the system power supply level, e.g., 15 volts. A 15 volt power supply for the DVR stabilizer system 20 is thereby provided by the voltage level across the power supply capacitor 396.

During the time when AC power is provided on the power lines 25 and 26 across the DVR stabilizer system 20 of the present invention, the bulk capacitor 56 becomes charged to approximately the steady-state peak voltage level of the AC voltage waveform. Thus, a relatively large amount of energy can become stored in the bulk capacitor 56 during operation of the DVR stabilizer system. As a safety feature, a discharge circuit is preferably provided to ensure that the bulk capacitor 56 is fully and rapidly discharged after operation of the DVR stabilizer system is terminated, and before servicing of the system is attempted.

An exemplary discharge circuit 400 is illustrated in FIG. 8. Resistors 402 and 404 are connected across the terminals of the bulk capacitor 56 via a transistor 406. When the transistor 406 is turned on, the stored energy in the bulk capacitor 56 is rapidly discharged through the resistors 402 and 404. Transistor 406 is turned on by a high voltage level signal applied from the 15 volt supply voltage through diode 408 and resistors 410 and 412. When, following termination of the operation of the DVR stabilizer system 20, the independent power supply 94 drops out, the voltage stored across capacitor 414 supplies the turn-on voltage to the transistor 406 for an amount of time sufficient to finish the discharging of the bulk capacitor 56 through the resistors 402 and 404. The discharge transistor 406 is held off when the DVR stabilizer system 20 is in operation by transistor 416 which, when turned on, turns transistor 406 off. A fixed voltage level is derived from the AC signal appearing on the power lines 25 and 26 by diode 418, resistor 420, and zener diode 422. This fixed bias voltage level is applied to the transistor 416, turning transistor 416 on as long as an AC voltage waveform appears on the power lines 25 and 26, thereby preventing discharge of the bulk capacitor 56 through the discharge circuit 400 when the DVR stabilizer system is active. Capacitor 424 and resistor 426 provide a filter for the bias signal applied to the transistor 416, to prevent discharging of the bulk capacitor 56 during zero-crosses of the AC voltage waveform on the lines 25 and 26. Resistor 428 provides current limiting, and resistor 430 is a pull-down resistor for transistor 416.

Figure 12:
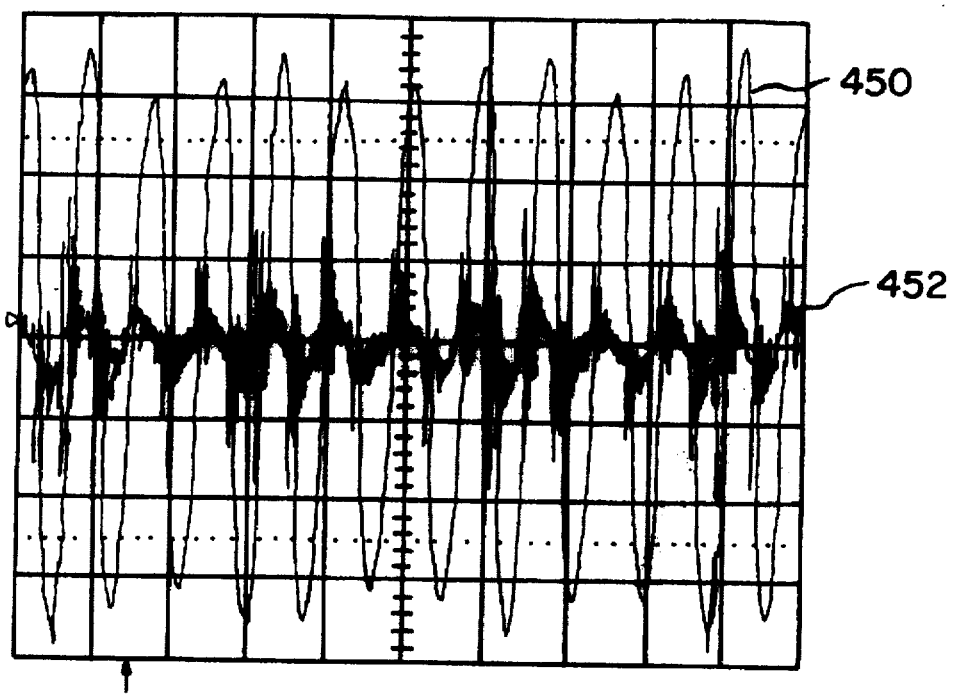
FIG. 12 is a diagram of output voltage and current waveforms illustrating operation of a UPS including a ferroresonant transformer providing power to a PFC load with no output voltage stabilization provided.
Figure 13:
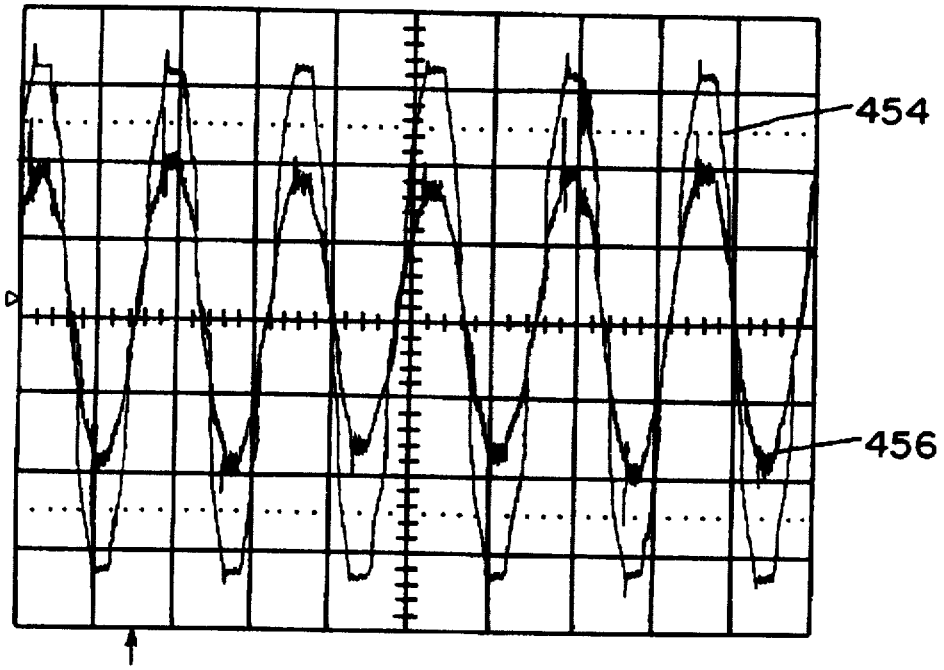
FIG. 13 is a diagram of output voltage and current waveforms illustrating operation of a UPS including a ferroresonant transformer providing power to multiple PFC loads with a dynamic voltage regulation stabilizer system in accordance with the present invention connected to the output of the UPS.

The voltage and current plots illustrated in the waveform diagrams of FIGS. 12 and 13 show the effectiveness of a DVR stabilizer system in accordance with the present invention when used to stabilize the output of a UPS including a ferroresonant transformer that is providing power to a PFC load. FIG. 12 is a plot of the output voltage 450 and current 452 waveforms for a 10 kVa Ferrups™ uninterruptible power supply providing power to a single 650 watt Onan PFC supply. The Ferrups UPS is a ferroresonant transformer based UPS made by Best Power, Inc., a division of General Signal. No corrective stabilization circuitry was used between the UPS and the PFC supply to obtain the waveforms of FIG. 12. Due to interactions between the ferroresonant UPS and the PFC supply, the RMS output voltage level varied from 137 to 113 volts. (Note the variations in the peaks of the output voltage waveform 450). The output voltage 454 and current 456 waveforms illustrated in FIG. 13 are for the same 10 kVa Ferrups UPS as was used to obtain the waveforms of FIG. 12, in this case, supplying power to seven 650 watt Onan PFC supplies. In this case, however, a DVR stabilizer system 20 in accordance with the present invention was installed between the UPS and the PFC supplies. Use of the DVR stabilizer system of the present invention results in a stable RMS output voltage signal between the UPS and the PFC supplies.

Although described throughout this specification with reference to a single phase power supply system, it should be apparent that the DVR stabilizer system of the present invention may be extended to polyphase, such as three phase, power supply systems. It should also be understood that the DVR stabilizer system of the invention may be utilized with any type of AC power supply system and load which may be effected by power supply/load interaction, and is not limited to use with power systems incorporating a transformer or PFC loads. In particular, a DVR stabilizer system in accordance with the present invention may be used in combination with soft source AC power supplies supporting motors and surge loads, to prevent collapse of the power supply output voltage under surge conditions. A DVR stabilizer system in accordance with the present invention may generally be employed as a line stiffener/surge reducer for such soft source AC power supplies.

It is understood that this invention is not confined to the particular embodiments and exemplary applications set forth herein as illustrative, but embraces such modified forms thereof as come within the scope of the following claims.

What is claimed is:

1. A dynamic voltage regulation stabilizer apparatus for use in an AC electrical power system of the type including a power supply providing AC power on output lines and a load connected to the output lines to receive power from the power supply, the stabilizer apparatus adapted to be connected in parallel with the load for suppressing instabilities of output power supplied from the power supply to the load, the stabilizer apparatus comprising:

(a) rectifier means for rectifying an AC voltage waveform on the output lines and having AC input nodes which are connected across the output lines from the AC power supply and which provides a unidirectional voltage at DC output nodes when the AC voltage is applied to the output lines;

(b) a clamping capacitor connected across the DC output nodes of the rectifier means, the size of the capacitor selected so that the charge on the capacitor is not substantially dissipated between peaks of the waveform of the AC voltage applied to the input nodes and the voltage across the capacitor remains at substantially the peak voltage of the AC voltage waveform, and wherein the capacitor serves to clamp the maximum voltage across the output lines to a selected voltage level near the steady state peak voltage on the output lines when the peak voltage on the output lines exceeds the steady state peak voltage;

(c) electronic switching devices connected between the clamping capacitor and the output lines, the switching devices being responsive to switching control signals which turn on the switching devices to apply the charge on the capacitor in either polarity to the output lines; and (d) switching device controller means for providing the switching control signals to turn on selected ones of the switching devices for a selected duration encompassing the time of the peak of each half-cycle of the AC voltage waveform to apply the charge on the capacitor to the output lines in alternating polarities at the peaks of alternating half-cycles such that the charge on the capacitor serves to raise the peak voltage across the output lines to a selected voltage level near the steady state peak voltage on the output lines when the peak voltage on the output lines drops below the steady state peak voltage.

2. The dynamic voltage regulation stabilizer apparatus of claim 1 wherein the rectifier means includes a full wave rectifier.

3. The dynamic voltage regulation stabilizer apparatus of claim 2 wherein the AC power supply system is a single phase system and the full wave rectifier includes four semiconductor diodes in a bridge configuration.

4. The dynamic voltage regulation stabilizer apparatus of claim 1 wherein the electronic switching devices are connected in a bridge configuration between the clamping capacitor and the output lines.

5. The dynamic voltage regulation stabilizer apparatus of claim 1 wherein the electronic switching devices are IGBTs.

6. The dynamic voltage regulation stabilizer apparatus of claim 1 wherein the selected duration encompassing the time of the peak of each half-cycle of the AC voltage waveform during which selected switching devices are turned on is centered in time around the time of the occurrence of the peak of the AC voltage waveform.

7. The dynamic voltage regulation stabilizer apparatus of claim 1 wherein the switching device controller means includes means for providing a peak detection signal for the selected duration encompassing the time of the peak of each half-cycle of the AC voltage waveform; means for providing a positive half-cycle detection signal during a positive half-cycle of the AC voltage waveform on the output lines;

means for providing a negative half-cycle detection signal during a negative half-cycle of the AC voltage waveform on the output lines; and means responsive to the peak detection signal and the positive and negative half-cycle detection signals for providing switching device control signals to turn on selected switching devices to apply the charge on the capacitor to the output lines in a positive polarity when the peak detection signal and the positive half-cycle detection signal are provided, and for providing switching device control signals to turn on other selected switching devices to apply the charge on the capacitor to the output lines in a negative polarity when the peak detection signal and the negative half-cycle detection signal are provided.

8. The dynamic voltage regulation stabilizer apparatus of claim 7 wherein the means for providing the switching device control signals includes means for combining the peak detection signal and the positive and negative half-cycle detection signals to provide a positive half-cycle peak detection signal when both the peak detection signal and the positive half-cycle detection signal are provided and to provide a negative half-cycle peak detection signal when both the peak detection signal and the negative half-cycle detection signal are provided, and a gate drive circuit means for providing the switching device control signals to the switching devices in response to the providing of the positive or negative half-cycle peak detection signals.

9. The dynamic voltage regulation stabilizer apparatus of claim 7 wherein the means for providing the peak detection signal for the selected duration encompassing the time of the peak of each half-cycle of the AC voltage waveform includes: a capacitor; means for detecting a zero-cross of the AC voltage waveform and for providing a zero-cross detection signal when a zero-cross of the AC voltage waveform is detected; means for rapidly discharging the capacitor in response to the providing of the zero-cross detection signal; means for gradually charging the capacitor during a half-cycle of the AC voltage waveform following the providing of the zero-cross detection signal; and means for providing the peak detection signal when the charge on the capacitor reaches a low voltage threshold level during the half-cycle and for terminating the providing of the peak detection signal when the charge on the capacitor reaches a high voltage threshold level during the half-cycle, wherein the low and high voltage threshold levels are selected such that the peak detection signal is provided for a selected duration encompassing the time of each half-cycle peak which is established by the difference between the low and high voltage threshold levels.

10. The dynamic voltage regulation stabilizer apparatus of claim 9 wherein the means for gradually charging the capacitor includes means for charging the capacitor in a linear manner by providing a constant current to the capacitor during the half-cycle of the AC voltage waveform.

11. The dynamic voltage regulation stabilizer apparatus of claim 9 wherein the low and high voltage threshold levels are selected such that the selected duration during which the peak detection signal is provided is centered in time around the time of occurrence of the peak of the AC voltage waveform.

12. The dynamic voltage regulation stabilizer apparatus of claim 1 comprising additionally means for monitoring a level of current from the clamping capacitor through the electronic switching devices, and means for controlling the switching device controller means to remove the switching device control signals that would allow conduction of the switching devices when the current level exceeds a current limit threshold level.

13. The dynamic voltage regulation stabilizer apparatus of claim 1 comprising additionally means for monitoring a level of voltage on the output lines, and means for preventing the switching device controller means from providing the switching device control signals to turn on the switching devices when the voltage level is less than a low voltage threshold level.

14. The dynamic voltage regulation stabilizer apparatus of claim 1 wherein the switching device controller means includes power supply means for providing electrical power for the switching device controller means from the charge on the clamping capacitor.

15. An improved uninterruptible power supply of the type having a transformer therein with an input winding and an output winding, a battery providing DC voltage, an inverter operable to invert the DC voltage from the battery to an AC voltage applied to the input winding of the transformer such that the output winding of the transformer delivers AC power to output lines during a failure of power from a main power source, the output lines adapted to be connected to a load, the improvement comprising:

(a) rectifier means for rectifying the AC voltage waveform on the output lines and having AC input nodes which are connected across the output lines and which provides a unidirectional voltage at DC output nodes when the AC voltage is applied to the output lines;

(b) a clamping capacitor connected across the DC output nodes of the rectifier means, the size of the capacitor selected so that the charge on the capacitor is not substantially dissipated between peaks of the waveform of the AC voltage applied to the input nodes and the voltage across the capacitor remains at substantially the peak voltage of the AC voltage waveform, and wherein the capacitor serves to clamp the maximum voltage across the output lines to a selected voltage level near the steady state peak voltage on the output lines when the peak voltage on the output lines exceeds the steady state peak voltage;

(c) electronic switching devices connected between the clamping capacitor and the output lines, the switching devices being responsive to switching control signals which turn on the switching devices to apply the charge on the capacitor in either polarity to the output lines; and (d) switching device controller means for providing the switching control signals to turn on selected ones of the switching devices for a selected duration encompassing the time of the peak of each half-cycle of the AC voltage waveform to apply the charge on the capacitor to the output lines in alternating polarities at alternating peaks of the half-cycles such that the charge on the capacitor serves to raise the peak voltage across the output lines to a selected voltage level near the steady state peak voltage on the output lines when the peak voltage on the output lines drops below the steady state peak voltage.

16. The uninterruptible power supply of claim 15 wherein the transformer is a ferroresonant transformer.

17. The uninterruptible power supply of claim 15 wherein the rectifier means is a full wave rectifier including four semiconductor diodes in a bridge configuration.

18. The uninterruptible power supply of claim 15 wherein the electronic switching devices are connected in a bridge configuration between the clamping capacitor and the output lines.

19. The uninterruptible power supply of claim 18 wherein the electronic switching devices are IGBTs.

20. The uninterruptible power supply of claim 15 wherein the selected duration encompassing the time of the peak of each half-cycle of the AC voltage waveform during which selected switching devices are turned on is centered in time around the time of the occurrence of the peak of the AC voltage waveform.

21. The uninterruptible power supply of claim 15 wherein the switching device controller means includes means for providing a peak detection signal for the selected duration encompassing the time of the peak of each half-cycle of the AC voltage waveform; means for providing a positive half-cycle detection signal during a positive half-cycle of the AC voltage waveform on the output lines; means for providing a negative half-cycle detection signal during a negative half-cycle of the AC voltage waveform on the output lines; and means responsive to the peak detection signal and the positive and negative half-cycle detection signals for providing switching device control signals to turn on selected switching devices to apply the charge on the capacitor to the output lines in a positive polarity when the peak detection signal and the positive half-cycle detection signal are provided, and for providing switching device control signals to turn on other selected switching devices to apply the charge on the capacitor to the output lines in a negative polarity when the peak detection signal and the negative half-cycle detection signal are provided.

22. The uninterruptible power supply of claim 21 wherein the means for providing the peak detection signal for the selected duration encompassing the time of the peak of each half-cycle of the AC voltage waveform includes: a capacitor; means for detecting a zero-cross of the AC voltage waveform and for providing a zero-cross detection signal when a zero-cross of the AC voltage waveform is detected; means for rapidly discharging the capacitor in response to the providing of the zero-cross detection signal; means for gradually charging the capacitor during a half-cycle of the AC voltage waveform following the providing of the zero-cross detection signal; and means for providing the peak detection signal when the charge on the capacitor reaches a low voltage threshold level during the half-cycle and for terminating the providing of the peak detection signal when the charge on the capacitor reaches a high voltage threshold level during the half-cycle, wherein the low and high voltage threshold levels are selected such that the peak detection signal is provided for a selected duration encompassing the time of each half-cycle peak which is established by the difference between the low and high voltage threshold levels.

23. The uninterruptible power supply of claim 22 wherein the means for gradually charging the capacitor includes means for charging the capacitor in a linear manner by providing a constant current to the capacitor during the half-cycle of the AC voltage waveform.

24. The uninterruptible power supply of claim 15 comprising additionally means for monitoring a level of current from the clamping capacitor through the electronic switching devices, and means for controlling the switching device controller means to remove the switching device control signals that would allow conduction of the switching devices when the current level exceeds a current limit threshold level.

25. The uninterruptible power supply of claim 15 comprising additionally means for monitoring a level of voltage on the output lines, and means for preventing the switching device controller means from providing the switching device control signals to turn on the switching devices when the voltage level is less than a low voltage threshold level.

26. A method of stabilizing the output power from an AC power supply system which is provided on output lines which are connected to a load, the AC power supply system providing an AC voltage waveform on the output lines with alternating positive and negative peaks during the cycles of the AC waveform, comprising the steps of:

(a) connecting a rectifier across the output lines, the rectifier having DC output nodes at which a full wave rectified DC voltage appears when AC voltage is applied to the output lines;

(b) charging up a clamping capacitor connected across the output nodes of the rectifier from the AC voltage provided from the power supply system to the output lines and rectified by the rectifier, the capacitor being charged to a peak value near the steady state peak value of the AC voltage waveform;

(c) clamping the peak voltage of the AC voltage across the output lines to a selected voltage level near the steady state peak voltage on the output lines by diverting current from the power supply through the rectifier and the capacitor when the peak voltage on the output lines exceeds the steady state peak value of the AC voltage waveform stored on the capacitor; and (d) applying the charge on the capacitor to the output lines in a positive polarity for a selected duration encompassing the time of a positive peak of the AC voltage waveform and applying the charge on the capacitor to the output lines in a negative polarity for the selected duration encompassing the time of a negative peak of the AC voltage waveform such that the charge on the capacitor raises the peak voltage across the output lines to a selected voltage level near the steady state peak voltage on the output lines when the peak voltage on the output lines drops below the steady state peak value of the AC voltage waveform stored on the capacitor.

27. The method of claim 26 wherein the selected duration encompassing the time of the peak of the AC voltage waveform during which the charge on the capacitor is applied to the output lines is centered in time around the time of the occurrence of the peak of the AC voltage waveform.

28. The method of claim 26 wherein the steps of applying the charge on the capacitor to the output lines includes the steps of:

(a) providing a peak detection signal for the selected duration encompassing the time of the peak of each half-cycle of the AC voltage waveform;

(b) providing a positive half-cycle detection signal during a positive half-cycle of the AC voltage waveform on the output lines;

(c) providing a negative half-cycle detection signal during a negative half-cycle of the AC voltage waveform on the output lines;

(d) applying the charge on the capacitor to the output lines in a positive polarity when the peak detection signal and the positive half-cycle detection signal are provided; and (e) applying the charge on the capacitor to the output lines in a negative polarity when the peak detection signal and the negative half-cycle detection signal are provided.

29. The method of claim 28 wherein the step of providing the peak detection signal includes the steps of:

(a) detecting a zero-cross of the AC voltage waveform and providing a zero-cross detection signal when a zero-cross of the AC voltage waveform is detected;

(b) rapidly discharging a capacitor in response to the providing of the zero-cross detection signal;

(c) gradually charging the capacitor during a half-cycle of the AC voltage waveform following the providing of the zero-cross detection signal;

(d) providing the peak detection signal when the charge on the capacitor reaches a low voltage threshold level during the half-cycle; and (e) terminating the providing of the peak detection signal when the charge on the capacitor reaches a high voltage threshold level during the half-cycle, wherein the low and high voltage threshold levels are selected such that the peak detection signal is provided for a selected duration encompassing the time of each half-cycle which is established by the difference between the low and high voltage threshold levels.

30. The method of claim 29 wherein the step of gradually charging the capacitor includes the step of providing a constant current to the capacitor during the half-cycle of the AC voltage waveform to charge the capacitor in a linear manner.

31. The method of claim 26 comprising additionally the steps of monitoring a level of current provided from the clamping capacitor to the output lines, and preventing execution of the step of applying the charge on the capacitor to the output lines when the current level exceeds a current limit threshold level.

32. The method of claim 26 comprising additionally the steps of monitoring a level of voltage on the output lines, and preventing execution of the step of applying the charge on the capacitor to the output lines when the voltage level is less than a low voltage threshold level.

* * * * *